US007681873B2

(12) United States Patent
Tsutsui et al.

(10) Patent No.: US 7,681,873 B2
(45) Date of Patent: Mar. 23, 2010

(54) SHEET PROCESSING APPARATUS AND IMAGE FORMING APPARATUS COMPRISING SAME

(75) Inventors: Kazuya Tsutsui, Shinogawa-machi (JP); Shingo Matsushita, Yokohama (JP); Tamaki Kaneko, Fujisawa (JP)

(73) Assignee: Ricoh Co., Ltd., Tokyo (JP)

( * ) Notice: Subject to any disclaimer, the term of this patent is extended or adjusted under 35 U.S.C. 154(b) by 527 days.

(21) Appl. No.: 11/634,156

(22) Filed: Dec. 6, 2006

(65) Prior Publication Data

US 2007/0138730 A1 Jun. 21, 2007

(30) Foreign Application Priority Data

Dec. 6, 2005 (JP) ..... 2005-352142
Dec. 8, 2005 (JP) ..... 2005-355105

(51) Int. Cl.
*B65H 37/04* (2006.01)

(52) U.S. Cl. ..... 270/58.08; 270/58.09; 270/58.12; 270/52.18

(58) Field of Classification Search ..... 270/52.18, 270/58.08, 58.09, 58.12
See application file for complete search history.

(56) References Cited

U.S. PATENT DOCUMENTS 5,772,197 A * 6/1998 Aoki et al. ..... 270/58.08
6,402,006 B1 * 6/2002 Nunes et al. ..... 227/110
6,450,934 B1 * 9/2002 Coombs ..... 493/383
2002/0190456 A1 12/2002 Miyake

FOREIGN PATENT DOCUMENTS

EP 1 568 636 A1 8/2005
JP 01-313261 12/1989
JP 02-182495 7/1990
JP 02-276691 11/1990
JP 08-091686 4/1996
JP 09-048555 2/1997

(Continued)

OTHER PUBLICATIONS

European Patent Office Search Report dated Jun. 28, 2007, for corresponding European Patent Application No. 06125503.0-2314.

*Primary Examiner*—Gene Crawford
*Assistant Examiner*—Leslie A Nicholson, III
(74) *Attorney, Agent, or Firm*—Harness, Dickey & Pierce, P.L.C.

(57) ABSTRACT

The present invention provides a sheet processing apparatus, such as a finisher or sorter, for implementing predetermined processing such as alignment and stapling on an inserted sheet material (i.e. any sheet-form recording medium such as recording paper, transfer paper, or an OHP sheet), and an image forming apparatus comprising the sheet processing apparatus. The sheet processing apparatus comprises a rear end fence horizontal portion that contacts the end portion of the sheet member on the upstream side of a sheet member conveyance direction during alignment of the sheet member, a rear end fence vertical portion for supporting the other parts of the sheet member, and a staple unit for stapling the sheet member. The stapling direction in which a staple is punched by a stapler of the staple unit is set to be parallel to the rear end fence horizontal portion that contacts the rear end portion of the sheet member.

22 Claims, 34 Drawing Sheets

FOREIGN PATENT DOCUMENTS

| | | |
|---|---|---|
| JP | 09-048556 | 2/1997 |
| JP | 09-136760 | 5/1997 |
| JP | 09-208116 | 8/1997 |
| JP | 10-109809 | 4/1998 |
| JP | 10-120284 | 5/1998 |
| JP | 10-152259 | 6/1998 |
| JP | 10-194575 | 7/1998 |
| JP | 11-180628 | 7/1999 |
| JP | 11-240665 | 9/1999 |
| JP | 2000-063033 | 2/2000 |
| JP | 2000-136067 | 5/2000 |
| JP | 2000-185868 | 7/2000 |
| JP | 2001-031323 | 2/2001 |
| JP | 2002-234665 | 8/2002 |
| JP | 2004-042326 | 2/2004 |

* cited by examiner

SHEET PROCESSING APPARATUS AND IMAGE FORMING APPARATUS COMPRISING SAME

PRIORITY STATEMENT

This application claims benefit of priority under 35 U.S.C. §119 from Japanese Patent Application No. 2005-352142 filed on Dec. 6, 2005, and Japanese Patent Application No. 2005-355105 filed on Dec. 8, 2005, in the Japanese Patent Office, the disclosure of each which is incorporated herein by reference in its respective entirety.

BACKGROUND OF THE INVENTION

1. Field of the Invention

The present invention relates to a sheet processing apparatus, such as a finisher or sorter, for implementing predetermined processing such as alignment and stapling on an inserted sheet material (i.e. any sheet-form recording medium such as recording paper, transfer paper, or an OHP sheet), and an image forming apparatus comprising the sheet processing apparatus.

2. Description of the Background Art

To perform a stapling operation or folding operation on a sheet member such as sheets of paper conveyed from an image forming apparatus, the sheets of paper must be aligned, and even when a user collates the sheet members, the sheet members are preferably aligned. Hence, a sheet aligning apparatus for aligning the sheet members is typically provided in a sheet processing apparatus positioned on the downstream side of the image forming apparatus. In Japanese Patent Publication No. 2,783,326 (Prior Art 1), Japanese Patent Publication No. 2,783,327 (Prior Art 2), Japanese Patent Publication No. 3,617,926 (Prior Art 3), and Japanese Patent Publication No. 3,655,407 (Prior Art 4), for example, a sheet aligning apparatus, or more particularly a rear end fence for performing an alignment operation in a sheet conveyance direction, is annexed to a staple tray for stapling the sheets, and after being aligned, the sheets are stapled and transmitted to a discharge tray. Hence, the sheet processing apparatus is provided with two trays, i.e. the staple tray and the discharge tray.

Japanese Examined Patent Application Publication H8-9451 (Prior Art 5) discloses a sheet post-processing apparatus comprising discharging means for discharging a sheet, a first tray for supporting a part of the sheet discharged by the discharging means on the upstream side of a sheet discharge direction, a second tray capable of movement in a vertical direction, for supporting a downstream side part of the sheet that is supported by the first tray at the upstream side part thereof, stapling means for stapling the sheet that is supported by the first tray at the upstream side part thereof, and moving means for moving the stapled sheet to the second tray. The first and second trays are inclined such that an upstream side part thereof is low, and thus the sheet that is discharged by the discharging means is aligned while moving along the incline in the direction of the stapling means. It is also disclosed in Prior Art 5 that the discharging means discharge the sheet such that the sheet straddles the first tray and second tray in both a stapling mode and a non-stapling mode.

Japanese Patent Publication No. 3,284,782 (Prior Art 6) discloses a paper post-processing apparatus for implementing post-processing such as stapling or hole-punching on sheets of paper discharged from an image forming unit, comprising a single compiling tray having at least a paper collecting paddle and a paper aligning plate for aligning the sheets of paper discharged from the image forming unit, a paper post-processing machine disposed at a rear end portion of the compiling tray, a loading tray on which the sheets of paper discharged from the compiling tray are loaded, and a set discharge roller for discharging the sheets of paper (a set) that have been aligned on the compiling tray to the loading tray. One end of the sheets of paper on the compiling tray contact the loading tray, and the sheets of paper discharged from the image forming unit are discharged to the loading tray as a set via the compiling tray regardless of whether or not post-processing has been performed by the paper post-processing machine.

In the background art described in Prior Art 1 to Prior Art 4, a staple tray unit is provided as a dedicated structural member for performing a stapling operation, and therefore a structure provided for the purpose of stapling must be used even when the sheets are simply to be aligned. Moreover, there is no specific description of the shape or angle of incline of the staple tray unit for aligning the sheet member, and judging by the attached drawings, the staple tray unit is constituted by a non-vertical planar member having an appropriate incline. The staple tray is not used at all in modes where sheet alignment is not performed, and at these times becomes a useless structure.

Furthermore, when the sheet member is laid substantially horizontally and an alignment operation is performed thereon, the sheet member does not move under its own weight, and therefore a sheet member moving member such as a return roller must be provided. As a result, the number of structural members for ensuring that the sheet member moves increases. In turn, this leads to increases in the number of components, the structural complexity, the weight of the machine, operating noise, and cost.

Moreover, the sheet member may be disturbed by machine vibration or the like after being aligned initially by the sheet member moving member. To prevent the aligned sheet member from being disturbed again by machine vibration or the like, a member for holding the sheet member may be added, but this also leads to corresponding increases in the number of components, the structural complexity, the weight of the machine, and the cost of the machine. In addition, since a large sheet member is laid substantially horizontally in a similar manner, the size of the machine also increases.

Further, when performing stapling processing using the stapling means, if the staple is not punched in a substantially perpendicular direction to the aligned sheet member, the staple may buckle, leading to a decrease in stapling quality or a stapling defect. When the stapling means are rotated in a substantially vertical plane for the purpose of oblique stapling, the diagonally rotated stapling means attempt, under their own weight, to return to a parallel stapling condition, making it impossible to maintain a stable attitude. Hence, during oblique stapling, the staple cannot be held at a fixed angle of incline, leading to a decrease in stapling quality.

In the background art of Prior Art 5, the sheet member straddles the first tray and second tray and is loaded at an incline such that the conveyance upstream side thereof is low. However, the sheets are discharged so as to straddle the first tray and second tray in both the stapling mode and the non-stapling mode, which is disadvantageous in terms of space conservation.

According to the background art of Prior Art 6, one end of the paper on the compiling tray contacts the loading tray. However, there is no description of the positional relationship, for example the angle and so on, between the trays, and although the machine is small in size, space must be provided for the trays on the conveyance upstream side, which is disadvantageous in terms of space conservation.

Japanese Unexamined Patent Application Publication 2004-42326 (Prior Art 7) discloses a paper processing apparatus in which a stitcher portion having a staple housing portion and an extrusion portion and a clincher portion for bending the tip ends of the staple are constituted separately, for stapling a plurality of sheets of paper existing between the two stapler members using staples. The paper processing apparatus comprises first and second moving pedestals for moving the stitcher portion and clincher portion in parallel synchronously in a direction intersecting a paper conveyance direction, first driving means for driving the first and second moving pedestals, first and second rotating pedestals supported on the same axis as, and so as to be capable of rotating relative to, the first and second moving pedestals, respectively, second driving means for rotating the first and second rotating pedestals synchronously, and control means for executing parallel stapling or oblique stapling in a desired position on the basis of a difference in the amount or speed at which the moving pedestals and rotating pedestals are moved by the first driving means and second driving means. When moving to a subsequent stapling operation after executing parallel stapling or oblique stapling, the control means execute the stapling operation by moving the stitcher portion and clincher portion to a position which is closer to a stapling position than a home position thereof, this position being preset to ensure that paper conveyance is not impeded, and by moving the stitcher portion and clincher portion from this position in a single direction relative to the stapling position at all times.

Japanese Unexamined Patent Application Publication H11-180628 (Prior Art 8) discloses a sheet post-processing apparatus in which an image-formed sheet discharged from an image forming apparatus is discharged to a discharge tray by discharging means after being stapled. In this sheet post-processing apparatus, a pair of staplers for stapling image-formed sheets of various sizes can be driven by a single drive source and thereby moved in parallel and rotated. Stapling processing is performed on sheets of various small sizes by moving the staplers in parallel in a width direction orthogonal to a sheet conveyance direction, while stapling processing is performed on sheets of various large sizes by parallel-moving and rotating the staplers.

As described above, Prior Art 7 discloses an invention in which movement and rotation in the paper width direction are performed using separate drive sources. When a sheet member stapling mode includes two stapling modes, i.e. a so-called parallel stapling mode in which the staple is punched parallel to an end portion of the sheet member and an oblique stapling mode in which the staple is punched diagonally, the stapling mode is executed by driving a driving apparatus for parallel-moving a stapler provided for parallel stapling and a driving apparatus for diagonally rotating a stapler provided for oblique stapling individually. When two dedicated driving apparatuses (drive sources) are provided in this manner, the number of components increases, leading to increases in the cost and weight of the machine.

In the invention described in Prior Art 8, a single drive source is provided, but the two staplers move along a rail and are rotated using a cam mechanism. Since only one drive source is provided, a reduction in cost can be achieved in comparison with the invention described in Prior Art 7i, but the movement range thereof is restricted, and hence the stapling position is limited. Moreover, the central portion of the paper cannot be stapled, and hence in certain cases, it may be impossible to respond to the needs of the user.

Technologies relating to the present invention are also disclosed in, e.g. Japanese Unexamined Patent Application Publication H09-136760, Japanese Unexamined Patent Application Publication H09-208116, Japanese Unexamined Patent Application Publication H10-152259, Japanese Unexamined Patent Application Publication H10-194575, Japanese Unexamined Patent Application Publication H10-120284, Japanese Unexamined Patent Application Publication H11-240665, Japanese Unexamined Patent Application Publication 2000-185868, Japanese Unexamined Patent Application Publication 2000-136067, Japanese Unexamined Patent Application Publication 2001-031323, Japanese Unexamined Patent Application Publication 2002-234665, Japanese Patent Publication No. 3,273,351, and Japanese Patent Publication No. 3,247,826.

SUMMARY OF THE INVENTION

An object of the present invention is to provide a sheet processing apparatus with which the size of the apparatus can be reduced and space can be conserved while ensuring excellent stapling quality, and an image forming apparatus comprising the sheet processing apparatus.

The present invention has been designed in consideration of the conditions of the background art described above, and it is an object thereof to provide a sheet processing apparatus comprising a single drive source, and therefore having a simple structure, in which a wide stapling position selection range can be set so that the various needs of a user can be responded to, and an image forming apparatus comprising the sheet processing apparatus.

In an aspect of the present invention, a sheet processing apparatus comprises a first support member that contacts an end portion of a sheet member on an upstream side of a sheet member conveyance direction during alignment of the sheet member; a second support member for supporting another part of the sheet member; and a sheet stapling device for stapling the sheet member. A stapling direction of the sheet stapling device is parallel to a contact surface of the first support member.

In another aspect of the present invention, an image forming apparatus comprises a sheet processing apparatus. The sheet processing apparatus comprises a first support member that contacts an end portion of a sheet member on an upstream side of a sheet member conveyance direction during alignment of the sheet member, a second support member for supporting another part of the sheet member, and a sheet stapling device for stapling the sheet member, a stapling direction of the sheet stapling device being parallel to a contact surface of the first support member.

In another aspect of the present invention, a sheet processing apparatus comprises a stapling device for stapling an inserted sheet member; a moving device for moving the stapling device in an orthogonal direction to a sheet member conveyance direction; a single drive source for driving the moving device ; and a rotating device for rotating the stapling device by bringing a part of the stapling device into contact with a protrusion provided in a preset position during the process for moving the stapling device using the moving device.

In another aspect of the present invention, an image forming apparatus comprises a sheet processing apparatus. The sheet processing apparatus comprises a stapling device for stapling an inserted sheet member, a moving device for moving the stapling device in an orthogonal direction to a sheet member conveyance direction, a single drive source for driving the moving device, and a rotating device for rotating the stapling device by bringing a part of the stapling device into contact with a protrusion provided in a preset position during the process for moving the stapling device using the moving device.

BRIEF DESCRIPTION OF THE DRAWINGS

The above and other objects, features, and advantages of the present invention will become more apparent from the following detailed description taken with the accompanying drawings, in which.

DESCRIPTION OF THE PREFERRED EMBODIMENTS

Each embodiment of the present invention will be described in detail below with reference to the drawings.

First Embodiment

Figure 1:
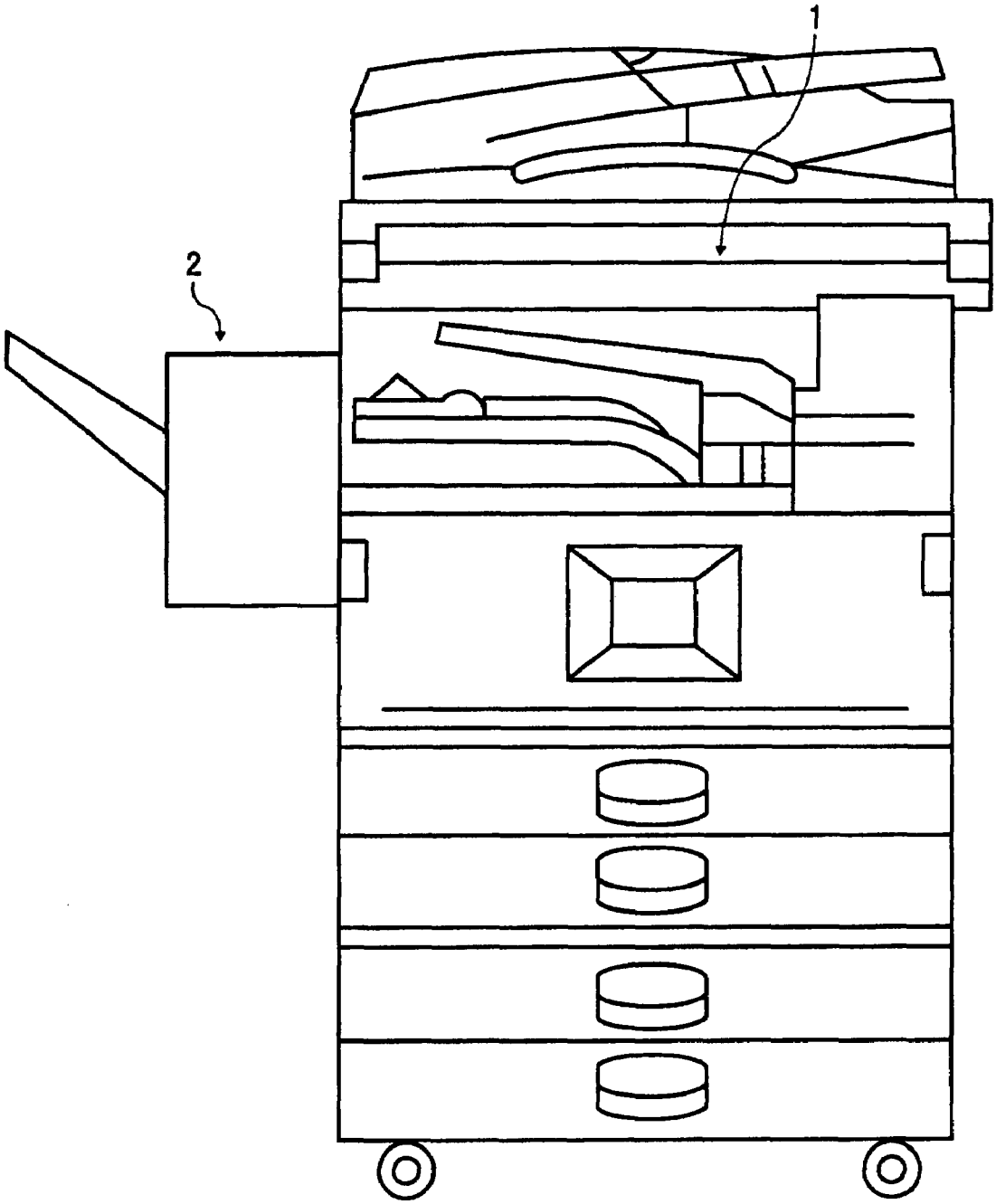
FIG. 1 is a view showing the overall structure of an image forming apparatus comprising a sheet processing apparatus according to the various embodiments of the present invention.

FIG. 1 shows the overall constitution of an image forming apparatus comprising a sheet processing apparatus according to all of the embodiments of the present invention, including this embodiment. As is evident from the drawing, a sheet processing apparatus 2 is provided on a side portion of a discharge side of an image forming apparatus 1, and implements so-called post-processing, such as an alignment operation (paper alignment operation), hole-punching, and stapling, on a sheet member formed with images. FIG. 1 shows only the part of the sheet processing apparatus 2 for performing an alignment operation.

Figure 2:
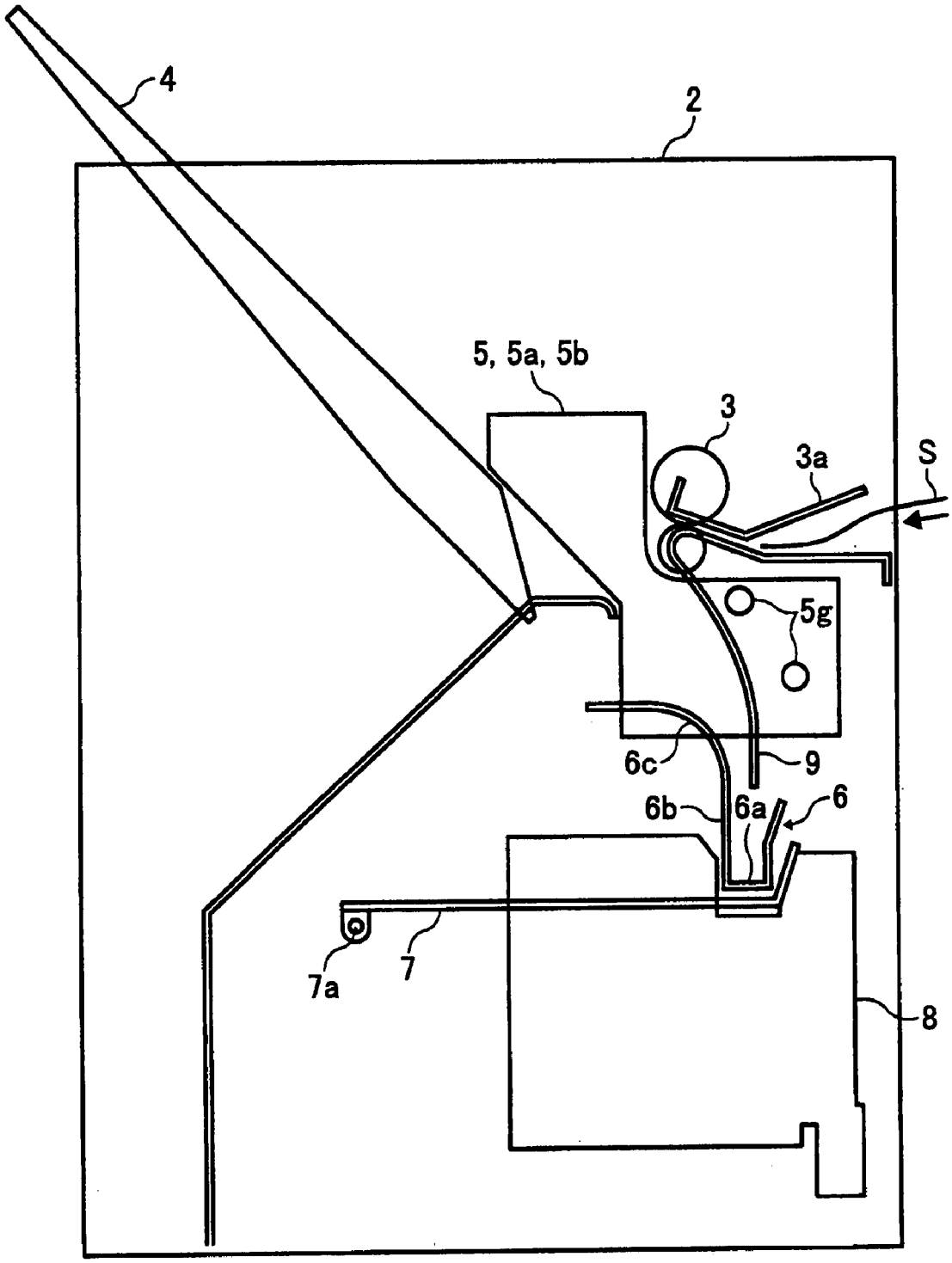
FIG. 2 is a view showing the schematic structure of a sheet processing apparatus according to a first embodiment of the present invention.

FIG. 2 shows the schematic structure of the sheet processing apparatus 2. The sheet processing apparatus 2 comprises an inlet roller 3, an inlet guide plate 3*a*, a discharge tray 4, a jogger 5, a rear end fence 6, and a discharge link 7. A sheet member S discharged by the image forming apparatus 1 advances along the inlet guide plate 3*a* to a nip formed by the inlet roller 3. The inlet roller 3 receives the sheet member S conveyed therein along the inlet guide plate 3*a*, and conveys the sheet member S into the sheet processing apparatus 2. The sheet member S is then discharged onto the discharge tray 4 or a sheet member loading unit of the jogger 5, to be described below. In this embodiment, the discharge tray 4 is inclined from a horizontal direction such that the downstream side thereof in a sheet member conveyance direction is higher than the upstream side by a predetermined angle. The jogger 5 is positioned at the lower side of the discharge tray 4, i.e. on the upstream side thereof in the sheet member conveyance direction. The jogger 5 aligns the sheet member S in an orthogonal direction (lateral direction) to the sheet member conveyance direction by pushing the end surface of the sheet member S from both sides, and comprises a front jogger 5*a* for aligning the front side of the sheet member S and a rear jogger 5*b* for aligning the rear side of the sheet member S, which together form a pair. The jogger 5 is supported by two guide rods 5*g*, which are disposed in a front-rear direction of the sheet processing apparatus 2, so as to be movable along the axial direction of the guide rods 5*g* in an orthogonal direction to the sheet member conveyance direction.

The rear end fence 6 aligns the sheet member S in the sheet member conveyance direction (vertical direction), and is provided on the lower side of the jogger 5 (the upstream side of the sheet member conveyance direction). Having been discharged onto the inclined surface of the discharge tray 4 or the jogger 5, the sheet member S slides down to the rear end fence 6 under its own weight until the rear end of the sheet member S (the end portion of the sheet member S on the upstream side of the sheet member conveyance direction) impinges on the rear end fence 6. The part of the rear end fence 6 on which the sheet member end portion impinges forms a substantially horizontal rear end fence horizontal portion 6*a*. A rear end fence vertical portion 6*b* is provided substantially perpendicular to the rear end fence horizontal portion 6*a*. An alignment guide plate 9 for guiding the rear end of the sheet member S to the horizontal portion 6*a* of the rear end fence 6 is disposed above the rear end fence 6. The discharge link 7 is provided below the rear end fence 6, and is supported rotatably by a spindle 7*a*. The rotary range of the discharge link 7 extends from the horizontal position shown in FIG. 2A to the rear end position of the discharge tray 4. The discharge link 7 possesses a function for moving the sheet member S up to the discharge tray 4 after the sheet member S has been loaded onto the discharge tray 4 and jogger 5 and caused to impinge on the rear end fence 6.

Hence, in this embodiment, the sheet member S must fall down to the horizontal portion 6*a* of the rear end fence 6 under its own weight for the rear end thereof to be aligned, and therefore the discharge tray 4 is inclined such that the downstream side thereof in the sheet member conveyance direction is higher than the upstream side by at least an angle enabling the sheet member S to fall under its own weight and contact the horizontal portion 6*a*.

A stapler 8 is provided below and in the vicinity of the rear end fence 6. A staple-punching position is set higher than the horizontal portion 6*a* of the rear end fence 6, and a staple-punching direction is set parallel to the horizontal portion 6*a*.

Next, referring to FIGS. 3 through 8, an operation to align the sheet member according to this embodiment will be described.

Figure 3:
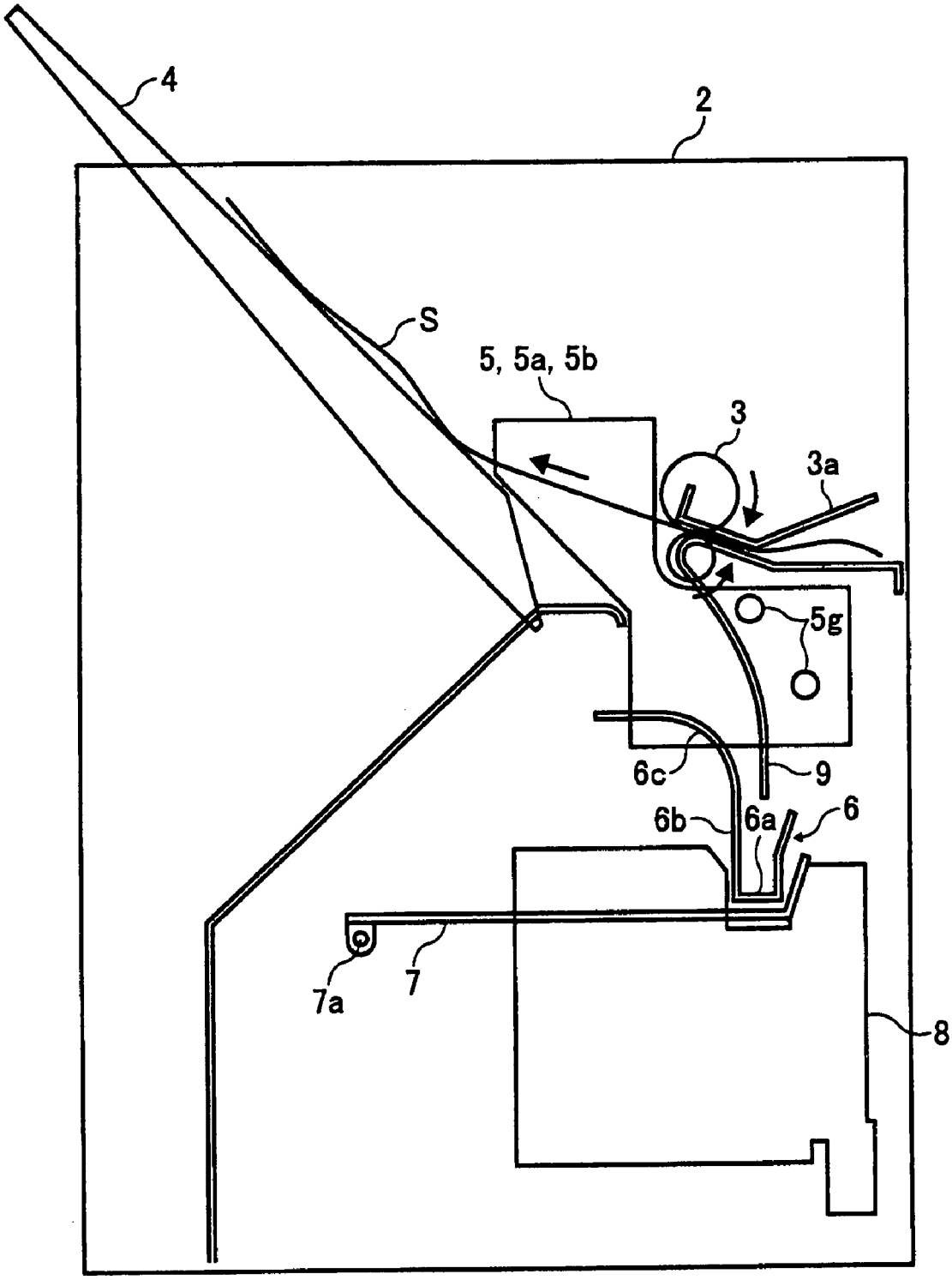
FIG. 3 is a view showing an operation for carrying in a sheet member in this sheet processing apparatus.
Figure 4:
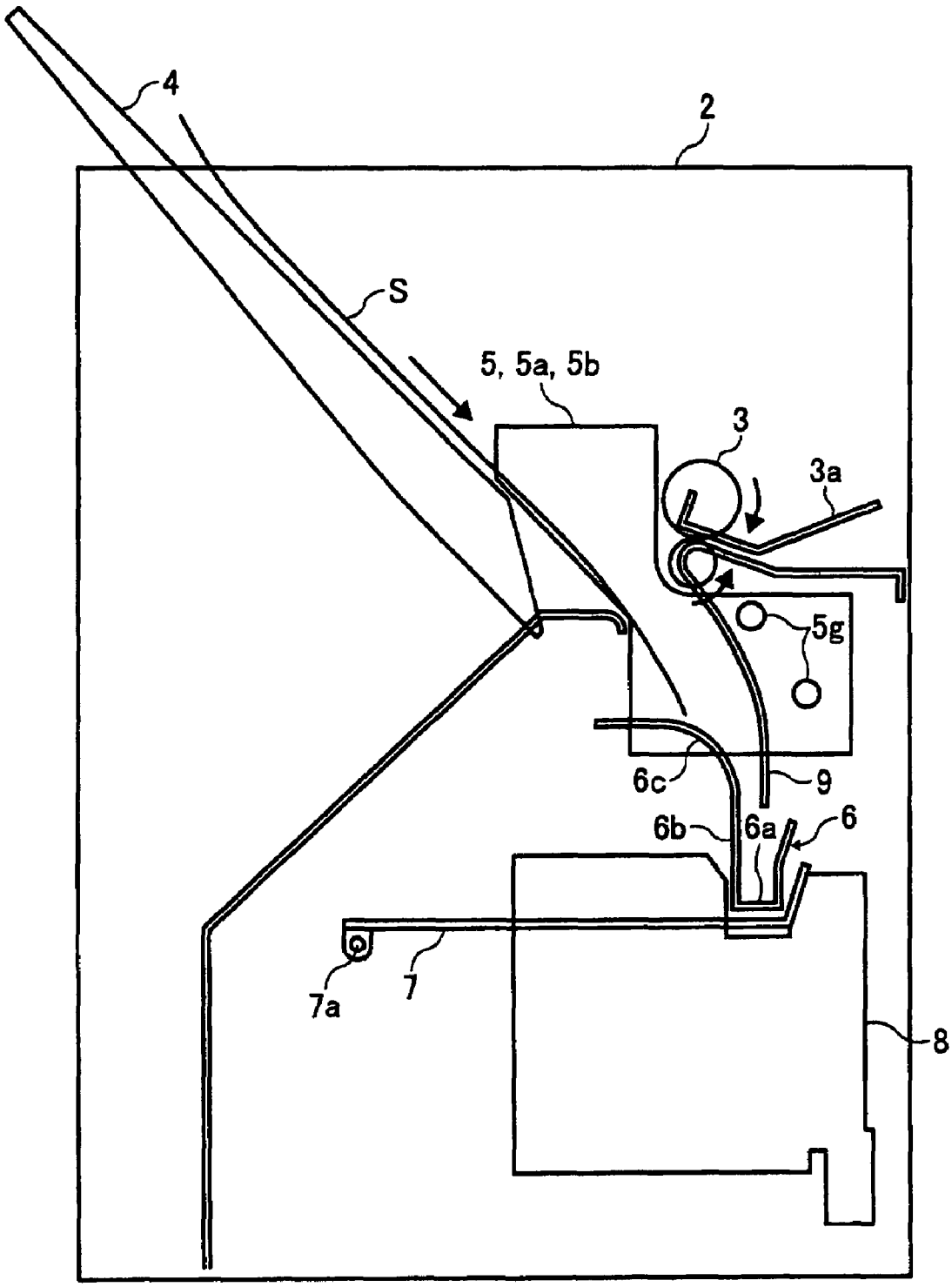
FIG. 4 is a view showing an operation for returning the sheet member under its own weight in this sheet processing apparatus.

FIG. 3 shows a condition in which the sheet member S, having been discharged from the image forming apparatus 1, is sandwiched in the inlet roller 3 and discharged to the discharge tray 4. FIG. 4 shows a condition in which the sheet member S, having been conveyed through the inlet roller 3 and discharged onto the discharge tray 4, slides down to the rear end fence 6 side under its own weight in accordance with the incline of the discharge tray 4. Here, the rear end of the sheet member S contacts a curved portion 6*c* of the rear end fence 6, and this curved portion 6*c* is set such that the sheet member S slides smoothly along the curve thereof to the horizontal portion 6*a* side.

Figure 5:
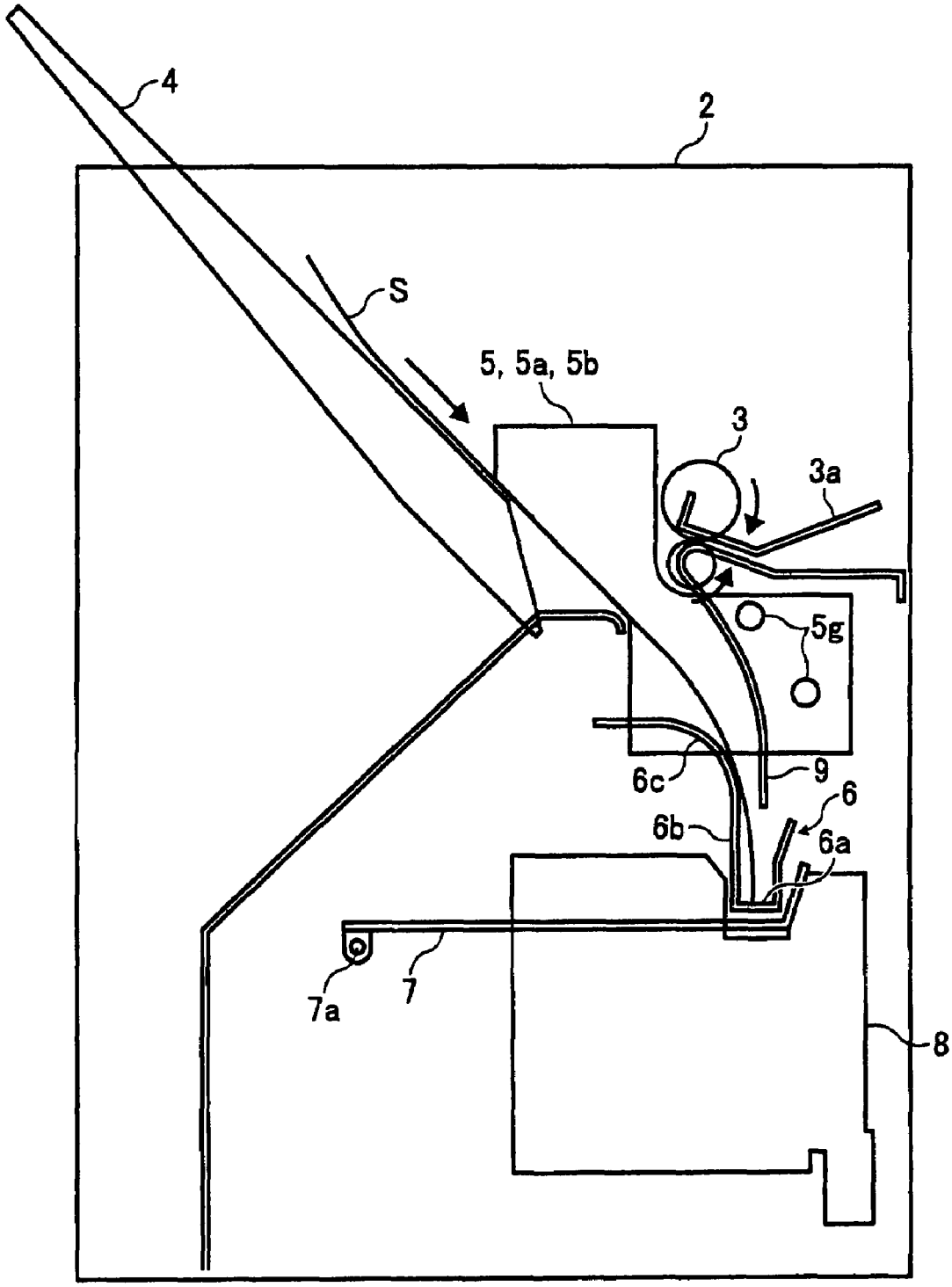
FIG. 5 is a view showing an operation (vertical alignment operation) for aligning the rear end of the sheet member in this sheet processing apparatus.
Figure 6:
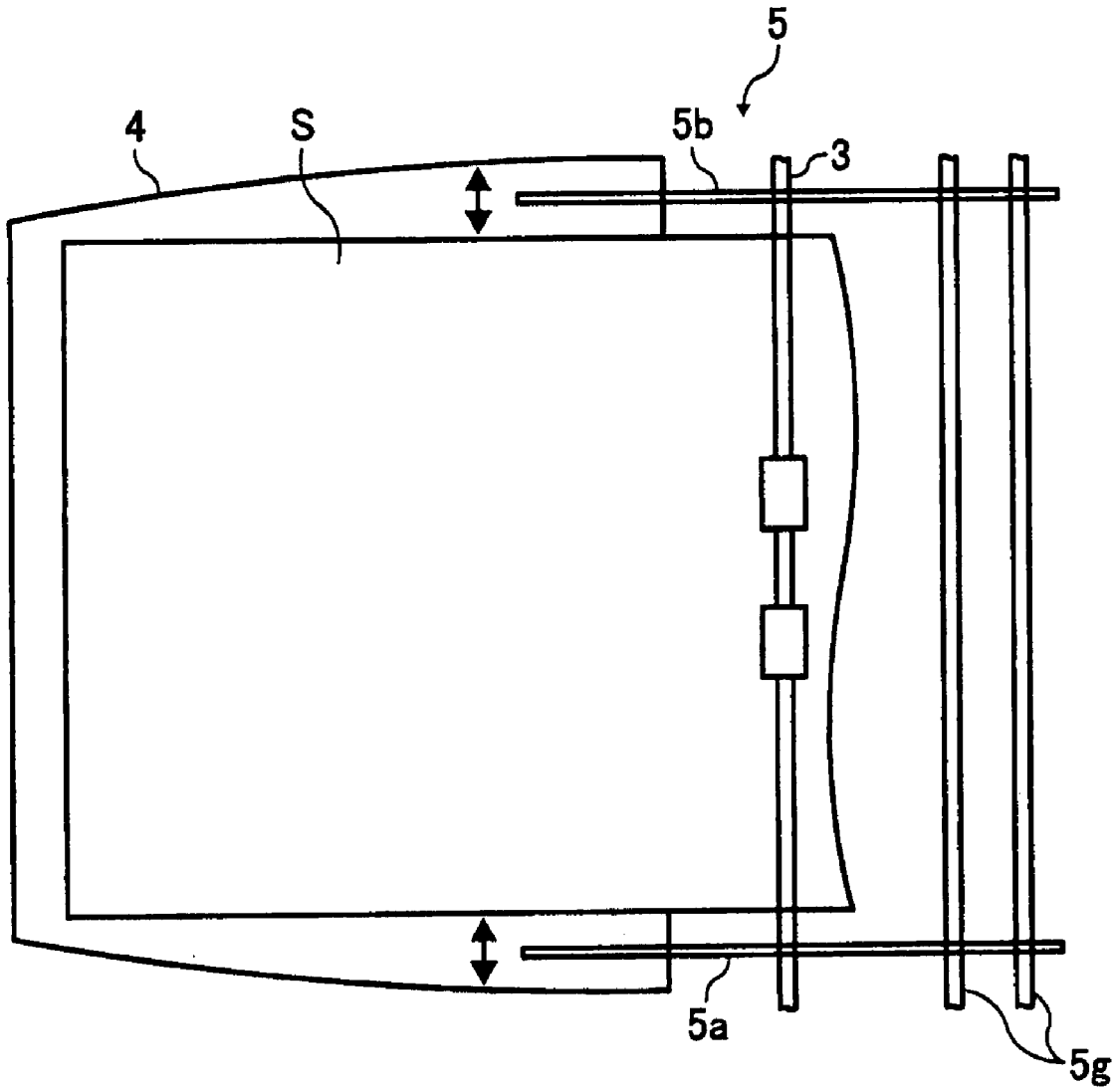
FIG. 6 is a view showing a simplification of a discharge tray part in this sheet processing apparatus.

FIG. 5 shows a condition in which the sheet member S falls further from the condition shown in FIG. 4 such that its rear end enters the rear end fence vertical portion 6*b* and impinges on the rear end fence horizontal portion 6*a*, whereby the sheet member S is aligned in the sheet member conveyance direction. FIG. 6 shows a simplification of the discharge tray part shown in FIG. 3. In FIG. 6, the jogger 5, which is on standby in a position removed from the side face of the sheet member S by a preset distance, reciprocates in the direction of the arrow in the drawing, thereby pushing the side faces (side ends) of the sheet member S such that the sheet member S is laterally aligned. Note that in the alignment operation of the jogger 5, only one of the front jogger 5*a* and rear jogger 5*b* may be operated, or both the front jogger 5*a* and rear jogger 5*b* may be operated. In this embodiment, either case is acceptable, and there are no particular limitations thereon.

Figure 7:
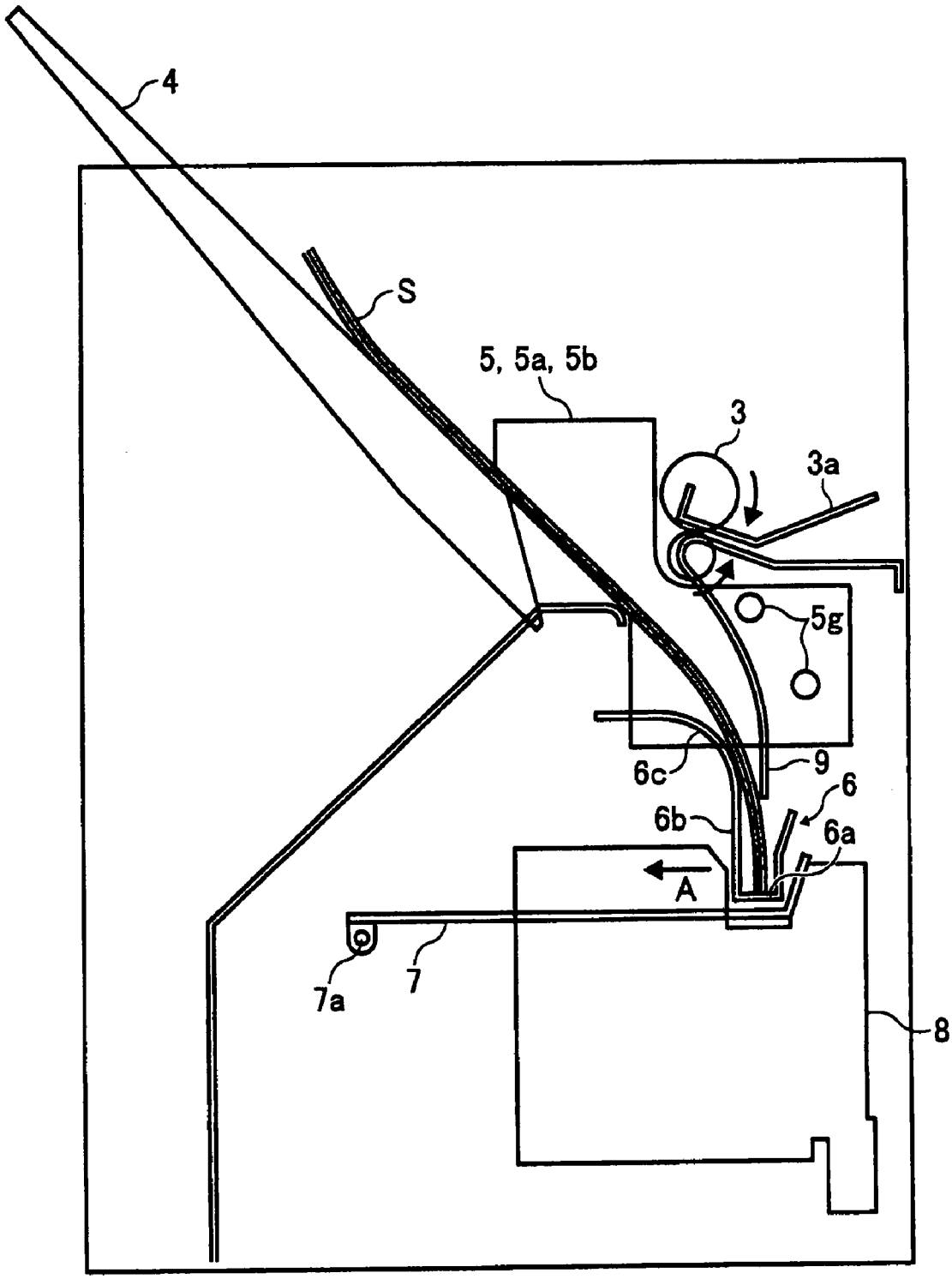
FIG. 7 is a view showing the operation (vertical alignment operation) for aligning the rear end of the sheet member.
Figure 8:
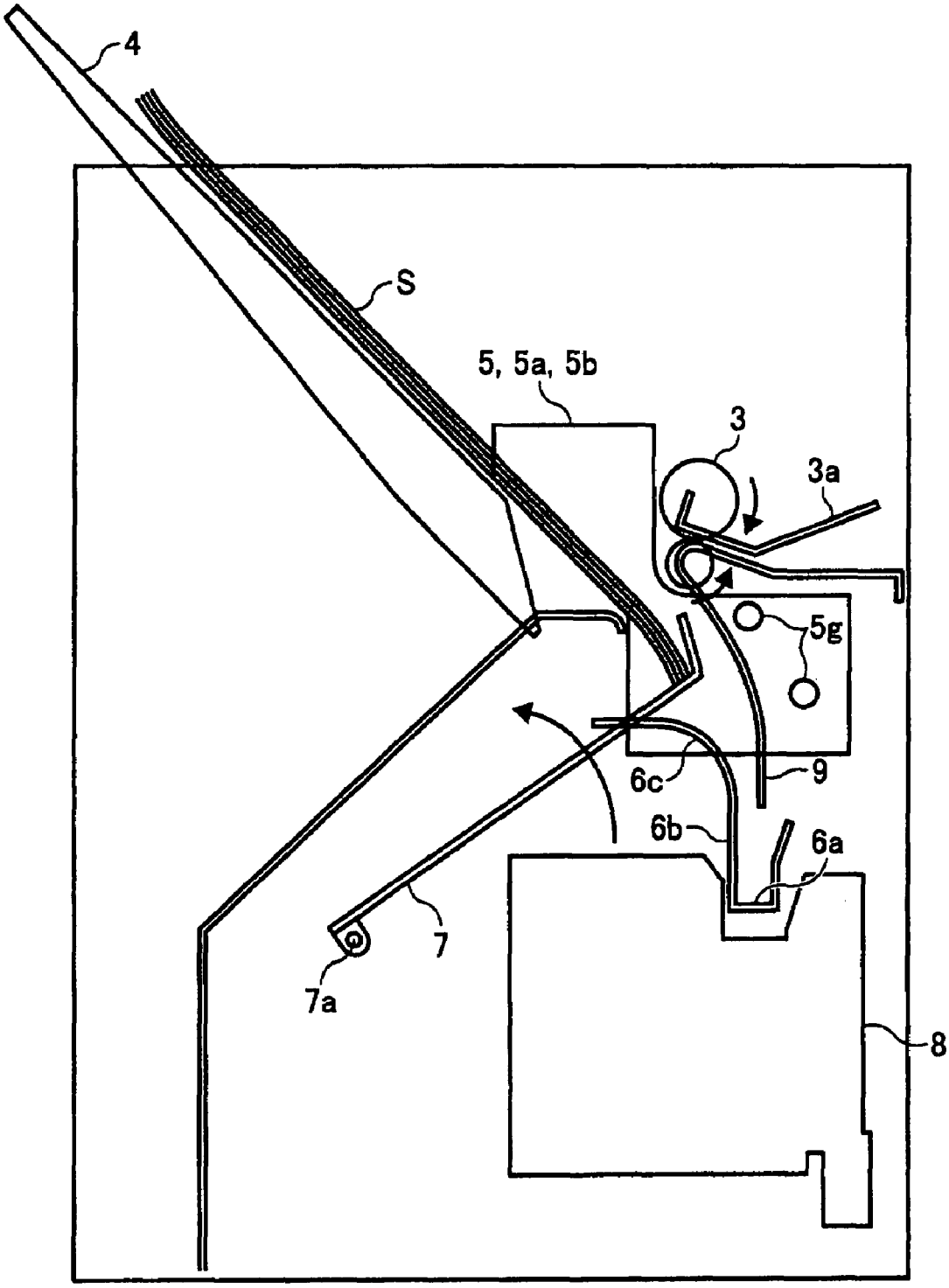
FIG. 8 is a view showing an operation for delivering a stack of the sheet members using a discharge link.

Once the operation illustrated in FIGS. 3 through 6 has been repeated for a specified number of sheets constituting one job, stapling processing is performed using the stapler 8, as shown in FIG. 7. Here, a staple is punched in a substantially horizontal direction A (the direction of the rear end fence horizontal portion 6*a*) such that the sheet member is penetrated in a substantially perpendicular direction thereto. When a bundle of sheets has been stapled in this manner, the sheet member S is pushed out by the rotation of the discharge link 7, as shown in FIG. 8, and moved in the direction of the discharge tray 4. As is evident from FIG. 8, the discharge link 7 pushes the bundle of sheets, which has been subjected to rear end alignment on the horizontal portion 6*a* of the rear end fence 6 at the rear end portion of the sheet member S, upward in the direction of the discharge tray 4.

Note that the discharge link 7 is rotated in the direction of the arrow shown in FIG. 8 by driving the spindle 7*a* using a motor and a speed-reducing mechanism driven by the motor, not shown in the drawing. When the operation is complete, the discharge link 7 is rotated in a direction opposite to the direction shown by the arrow and thereby returned to a horizontal position.

In a non-stapling mode, the push-out operation shown in FIG. 8 is performed following repetition of the operation shown in FIGS. 3 through 6 without performing the stapling processing shown in FIG. 7.

According to this embodiment, effects such as the following are obtained.

1) The rear end fence 6 for aligning the sheet member doubles as a conveyance path, and therefore sheet member alignment can be performed with an extremely simple structure by means of a simple sheet member alignment operation in which the paper is brought into contact with the rear end fence horizontal portion 6*a* under its own weight. As a result, simplification of the machine and reductions in its size and weight can be realized together with reductions in the number of components and the cost of the machine.

2) During stapling processing, a staple can be punched in a substantially perpendicular direction to the aligned sheet member, and therefore buckling of the staple and so on can be prevented such that a high stapling quality can be maintained.

Second Embodiment

Figure 9:
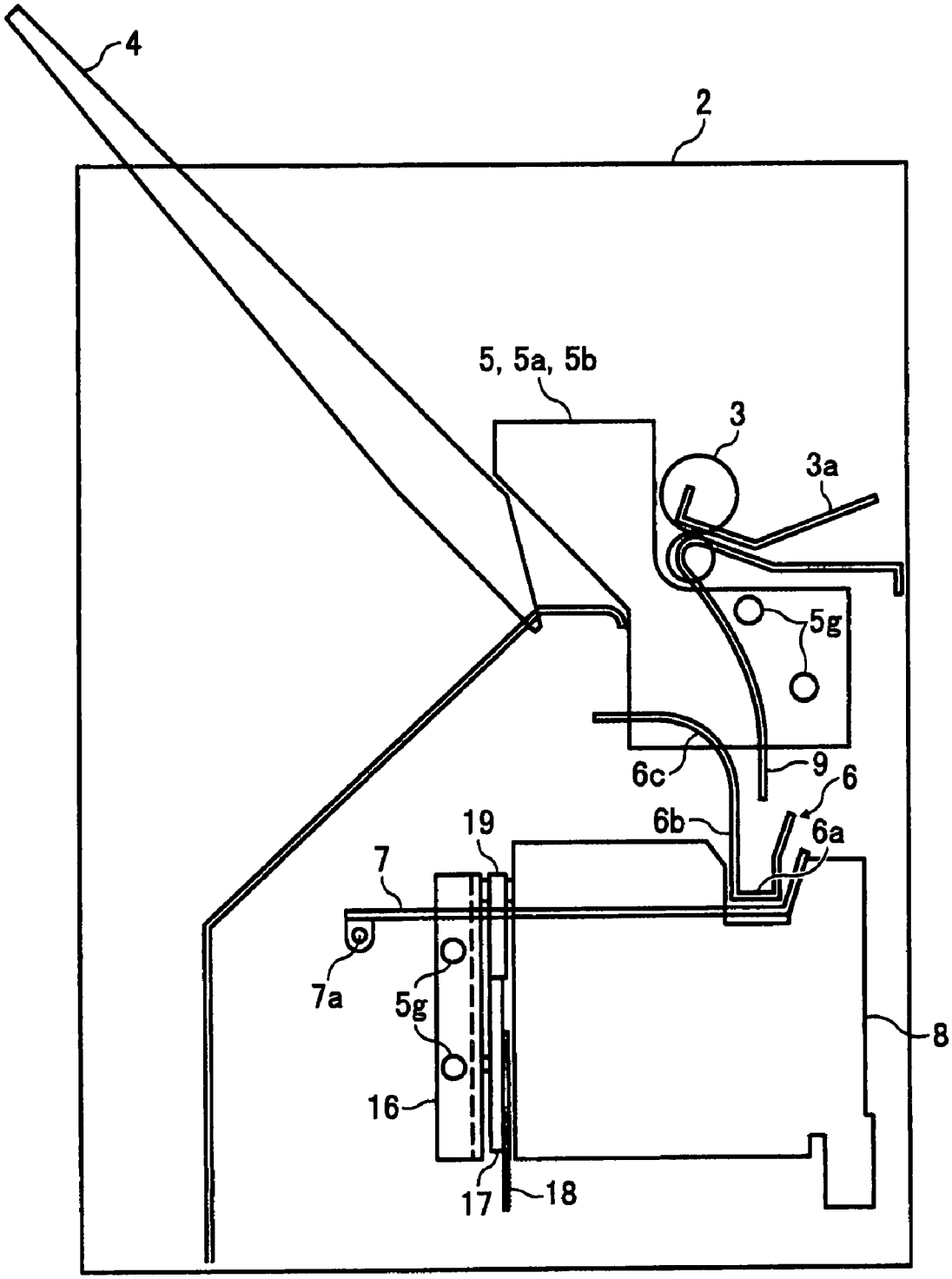
FIG. 9 is a view showing the schematic structure of a sheet processing apparatus according to a second embodiment of the present invention.
Figure 10A:
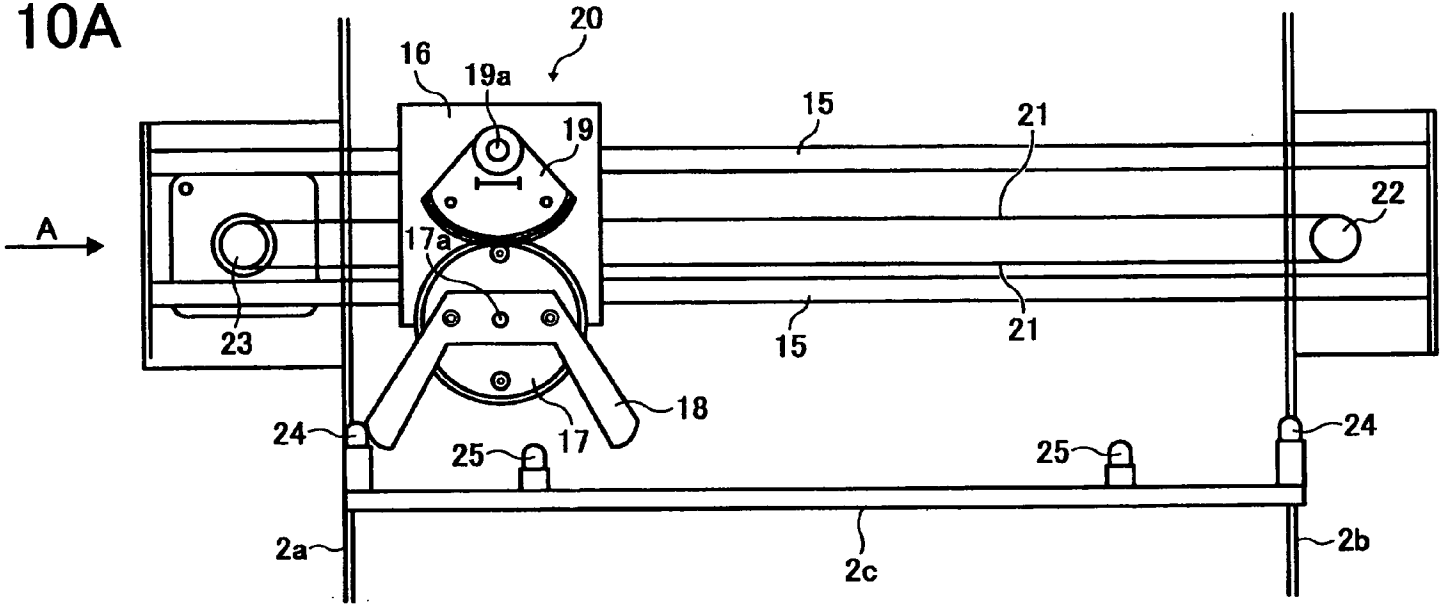
FIGS. 10A and 10B are views showing a movement mechanism of a stapler unitii of the sheet processing apparatus without a stapler.
Figure 10B:
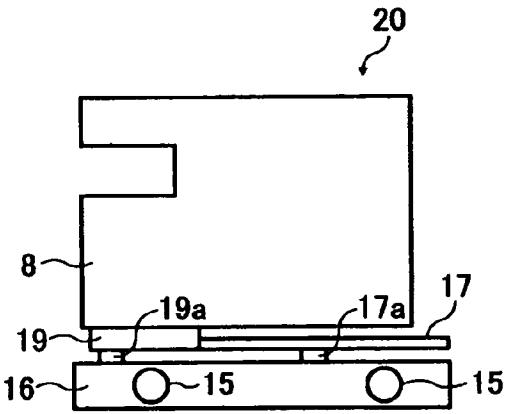

FIG. 9 shows the structure of a sheet processing apparatus according to this embodiment, while FIGS. 10A and 10B show a movement mechanism in a stapler unit thereof. In this embodiment, the stapler of the first embodiment can perform parallel stapling and oblique stapling using the driving force of a single drive source. All other structures are identical to the first embodiment, and therefore identical reference symbols have been allocated to identical elements, while redundant description has been omitted.

In FIGS. 10A and 10B, a pair of guide rods 15 are disposed in parallel between a front side plate 2*a* and a rear side plate 2*b* of the sheet processing apparatus 2, and attached to the front side plate 2*a* and rear side plate 2*b*. A pedestal 16 is mounted slidably on the guide rods 15. Shafts 17*a* and 19*a* are disposed in an upright manner on the pedestal 16, and a gear 17 and a sector gear 19 are attached rotatably to the shafts 17*a*, 19*a*. As shown in FIG. 9, the stapler 8 is carried on the sector gear 19 such that the stapler 8 and sector gear 19 rotate integrally. Further, the sector gear 19 meshes with the gear 17, and within the meshing range of the sector gear 19 and the gear 17, the two components perform a rotation operation in cooperation with each other. Two levers 18 are provided on the gear 17 so as to protrude from the outer peripheral portion of the gear 17. These members together constitute a stapler unit 20, and the stapler 8 itself rotates together with the rotation of the sector gear 19.

A timing belt 21 is wrapped around a pulley 23*a* of a pulley motor 23 and a pulley 22, and the pedestal 16 is fixed to the timing belt 21. Thus, as the pulley motor 23 rotates, the timing belt 21 rotates, and in accordance with this rotary movement, the pedestal 16 reciprocates along the guide rods 15. A pair of pins A 24 and a pair of pins B 25, protruding in the direction of the levers 18 in symmetrical positions relative to the conveyance center of the sheet member, are provided in positions corresponding to the movement track of the levers 18. In this embodiment, the pins A 24 and the pins B 25 are provided so as to protrude from a bracket 2*c* that is fixed between the front side plate 2*a* and rear side plate 2*b*.

Next, referring to FIGS. 11A, 11B, 12A, and 12B, an operation of the stapler 8 will be described.

Figure 11A:
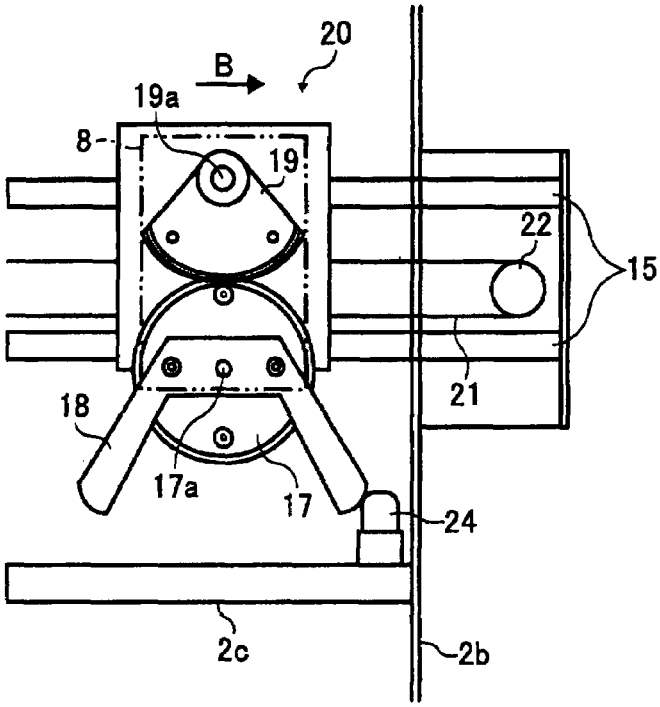
FIGS. 11A and 11B are views showing an operation of the stapler that is performed when the stapler shifts from a parallel stapling attitude to an oblique stapling attitude.
Figure 11B:
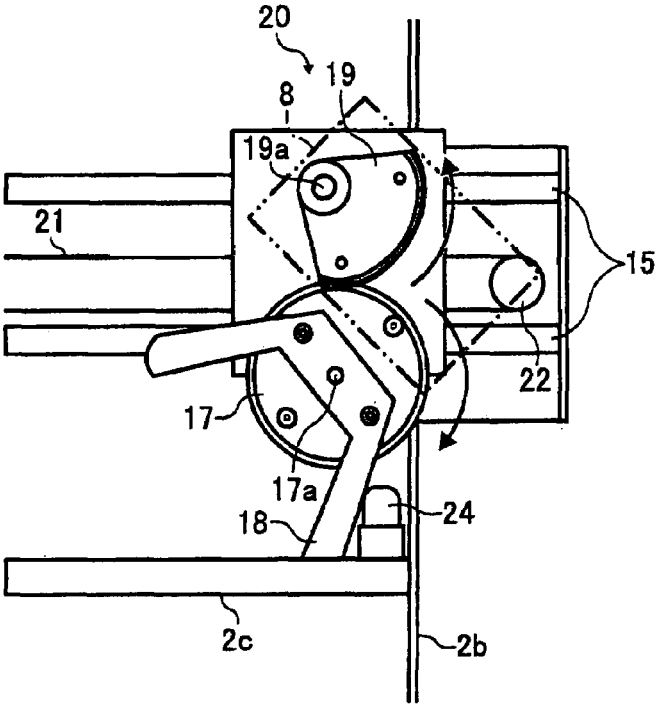
Figure 12A:
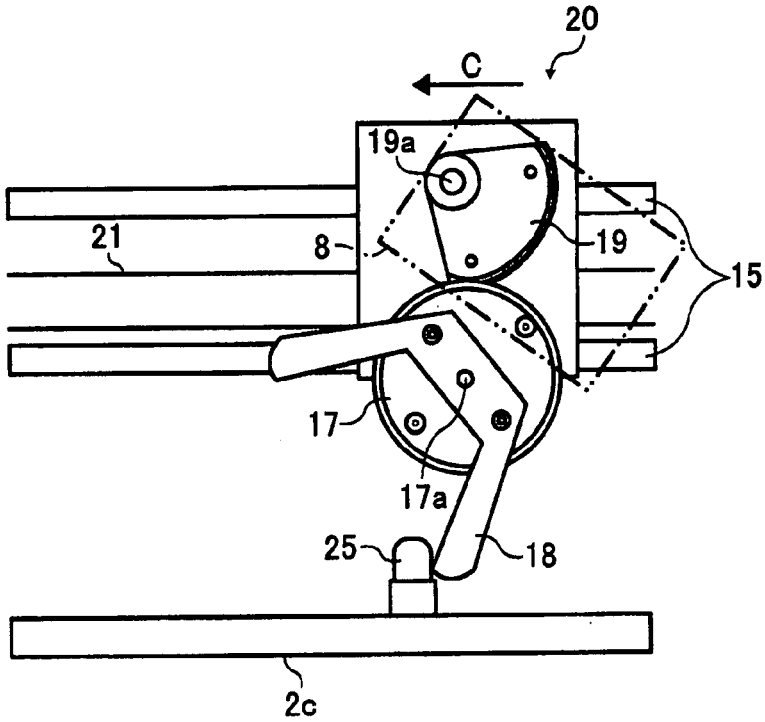
FIGS. 12A and 12B are views showing an operation of the stapler that is performed when the stapler shifts from the oblique stapling attitude to the parallel stapling attitude.
Figure 12B:
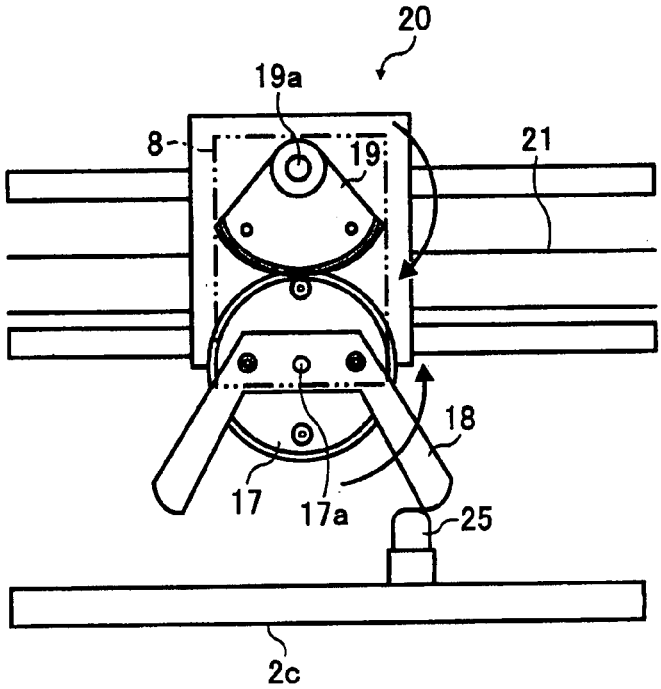

FIGS. 11A and 11B show an operation performed when the stapler 8 moves from a parallel stapling attitude to an oblique stapling attitude, while FIGS. 12A and 12B show an operation performed when the stapler 8 moves from the oblique stapling attitude to the parallel stapling attitude. As shown in FIG. 11A, the stapler unit 20 is moved along the guide rods 15 in the direction of an arrow B by the driving force of the pulley motor 23, whereby the lever 18 comes into contact with the pin A 24. When the stapler unit 20 continues to move from this contact position, as shown in FIG. 11B, the lever 18 rotates, and the gear 17 rotates simultaneously. Accordingly, the sector gear 19 rotates, causing the stapler 8 to rotate into a tilted state. After rotating by a preset amount, the direct advancement of the stapler unit 20 stops, whereupon the stapler unit 20 moves along the guide rods 15 in the opposite direction while maintaining its rotated state. The stapler unit 20 then stops in a predetermined position for performing stapling processing, and performs a stapling operation. As a result, oblique stapling is performed at an angle tilted in accordance with the rotation amount.

As shown in FIGS. 12A and 12B, when moving the stapler 8 from the oblique stapling attitude to the parallel stapling attitude, the stapler unit 20 is moved along the guide rods 15 by the pulley motor 23 in the direction of an arrow C, i.e. in an opposite direction to the case shown in FIG. 11A. At this time, the lever 18 rotates after coming into contact with the pin B 25, and the gear 17 rotates in accordance therewith. The sector gear 19 and stapler 8 rotate in accordance with this rotation until the stapler 8 is set in the parallel stapling condition. At exactly this time, the lever 18 passes the pin B 25, and thus the stapler 8 stops rotating and enters a parallel state. In this state, the stapler unit 20 is halted in a predetermined position for performing stapling processing, and thus parallel stapling can be performed. The protrusion length of the pins A 24 and the pins B 25 and the length of the levers 18 are set such that the operation described above is possible. More specifically, the protrusion amount of the pin B 25 is set such that the pin B 25 contacts the lever 18 in the oblique stapling condition but does not contact the lever 18 in the parallel stapling condition, while the protrusion amount of the pin A 24 is set such that the pin A24 contacts the lever 18 in the parallel stapling condition so as to move the stapler unit 20 to the oblique stapling condition.

Figure 13:
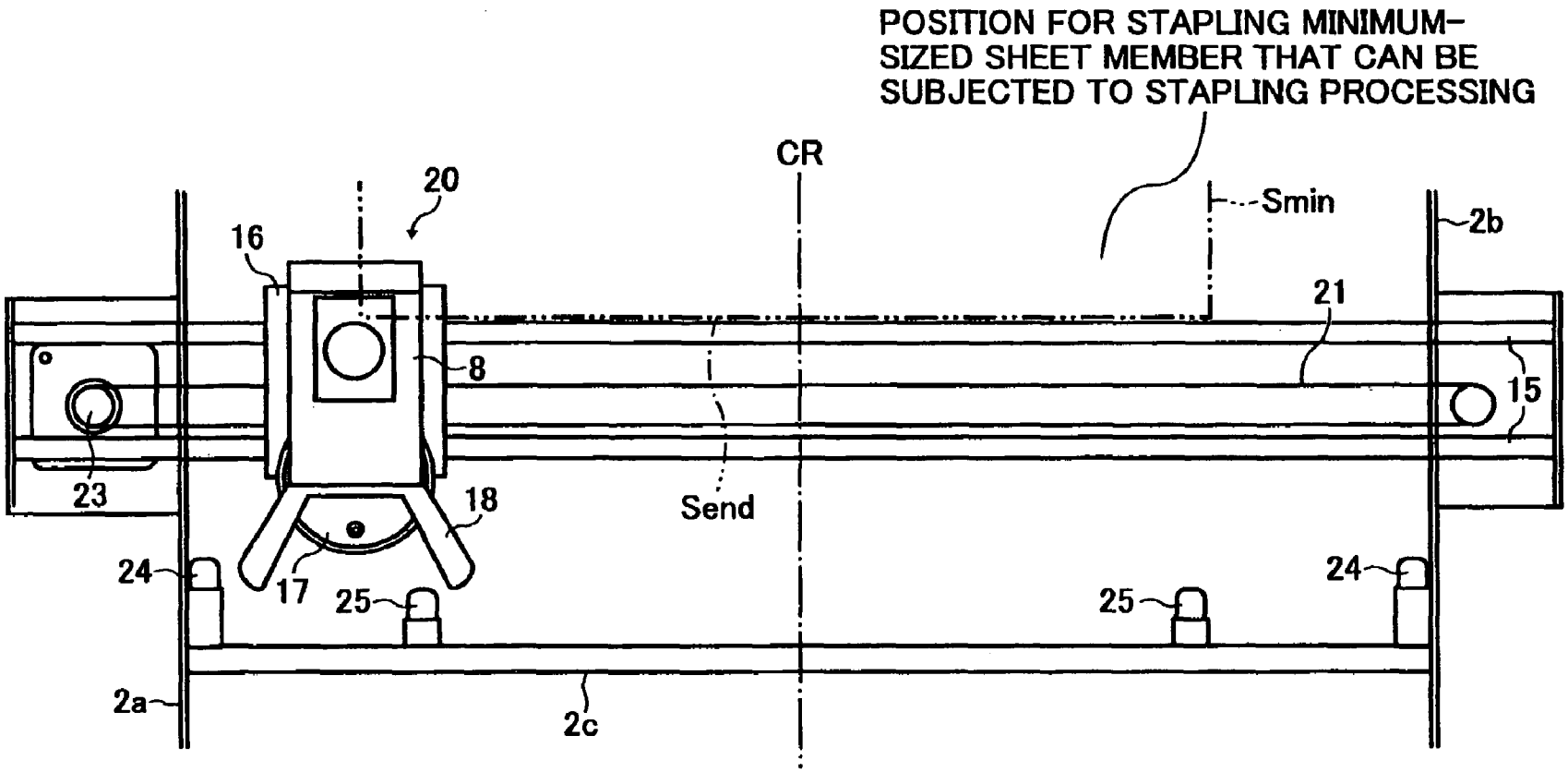
FIG. 13 is a view showing a relationship between a lever and pins A, B in a mechanism for rotating the stapler.

FIG. 13 shows the relationship with the sheet member at this time. As shown in the drawing, a plurality of the pins B 25 are provided in equally distributed positions (symmetrical positions) in relation to a sheet conveyance center CR. The pins B 25 are positioned further toward the sheet conveyance center CR side than a position in which a staple is punched in to a minimum-sized sheet member Smin that can be stapled obliquely by the sheet processing apparatus 2. Thus, oblique stapling can be performed in an arbitrary position in the part of the sheet member positioned between the pin A 24 and the adjacent pin B 25.

Next, referring to FIGS. 14 through 18, a stapling operation to staple the minimum-sized sheet member Smin will be described.

Figure 14:
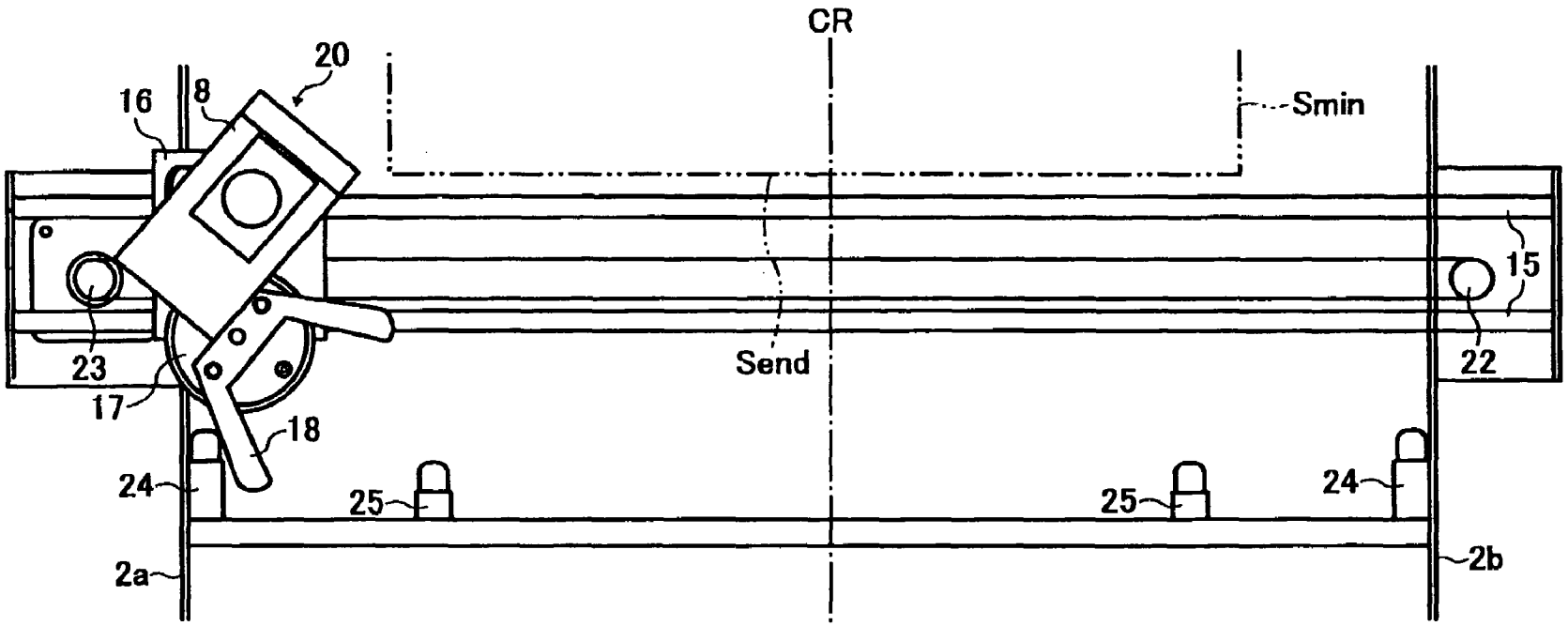
FIG. 14 is a view showing an oblique stapling condition in which the stapler unit is rotated diagonally by a front side plate-side pin A.
Figure 15:
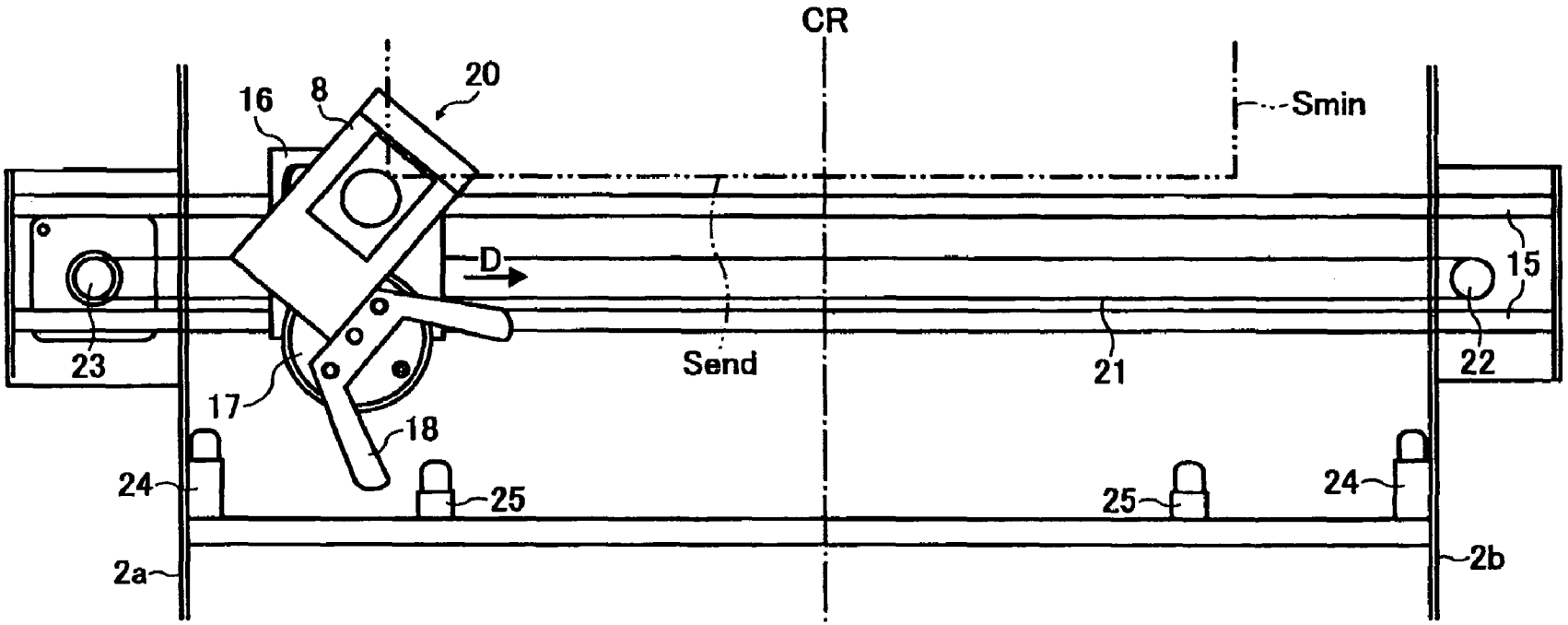
FIG. 15 is a view showing an operation performed to move the stapler to a stapling position while in the oblique stapling condition shown in FIG. 14.
Figure 16:
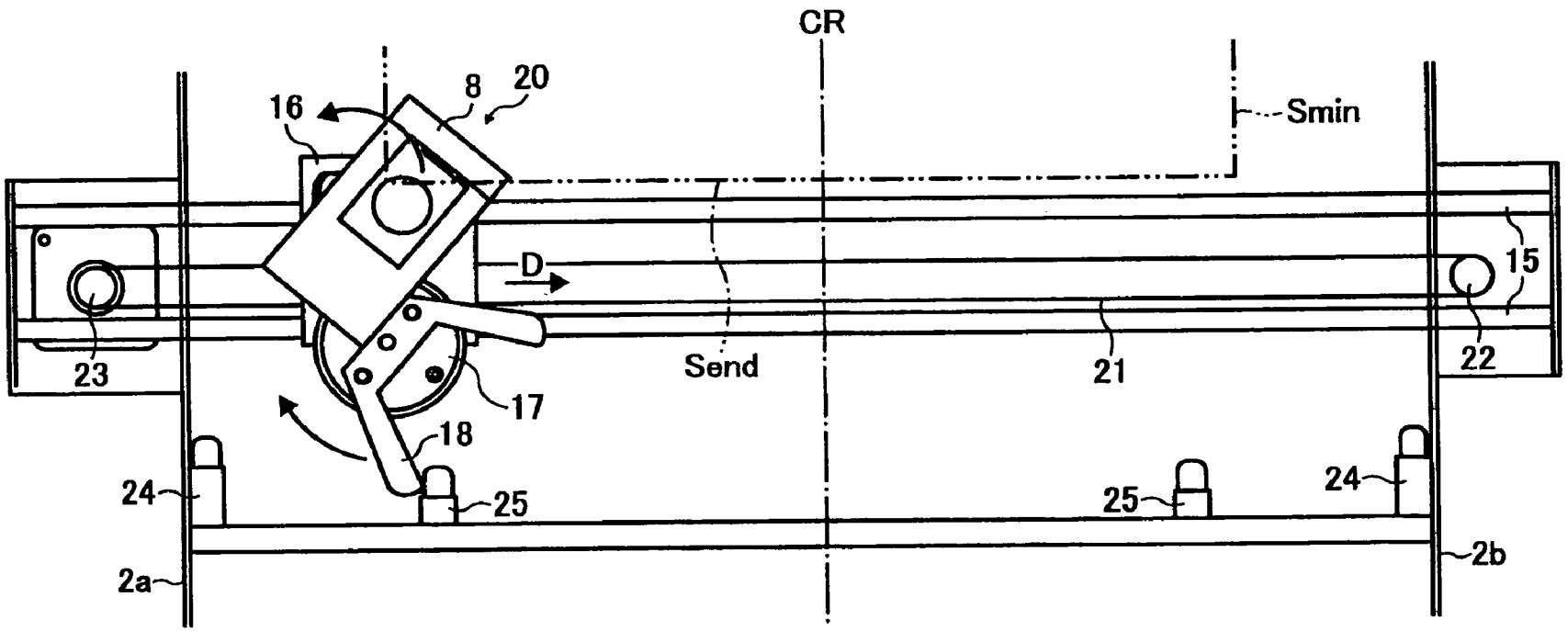
FIG. 16 is a view showing an operation performed at the start of movement from the oblique stapling condition to a parallel stapling condition.
Figure 17:
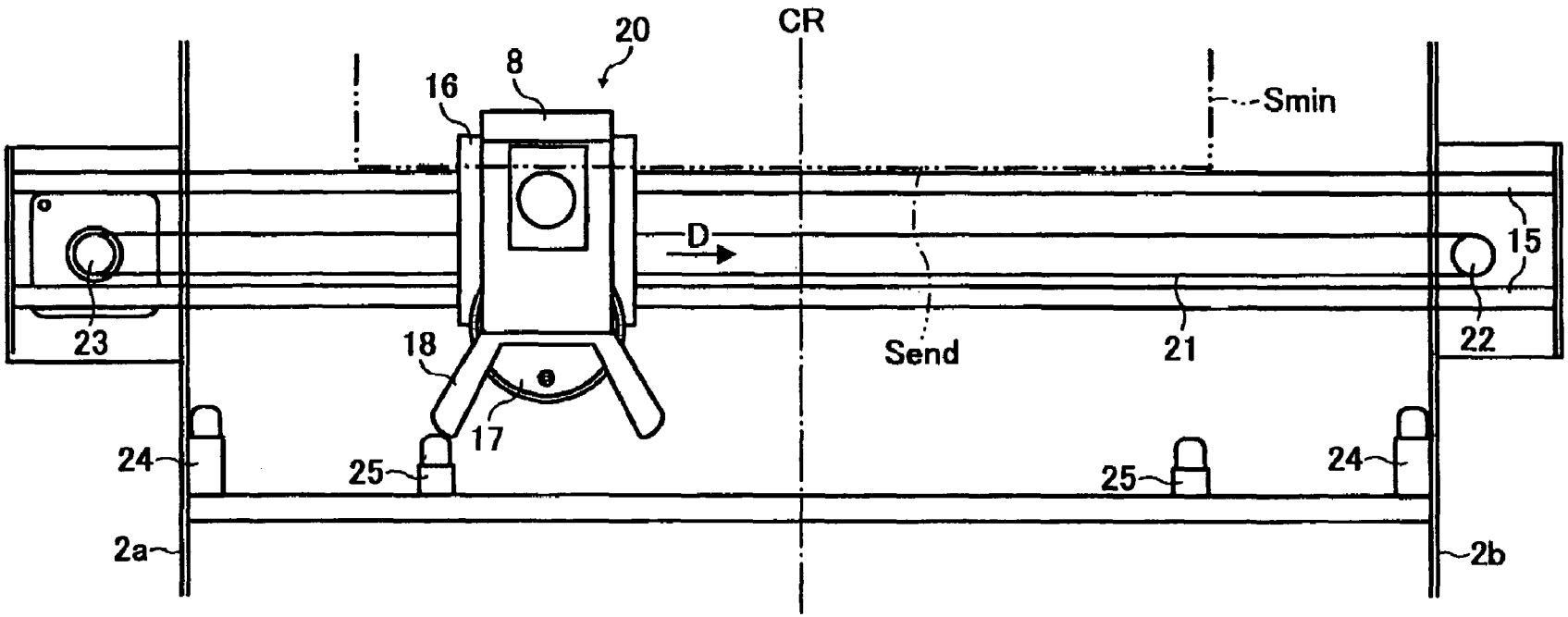
FIG. 17 is a view showing an operation performed at the end of movement from the condition shown in FIG. 16 to the parallel stapling condition.
Figure 18:
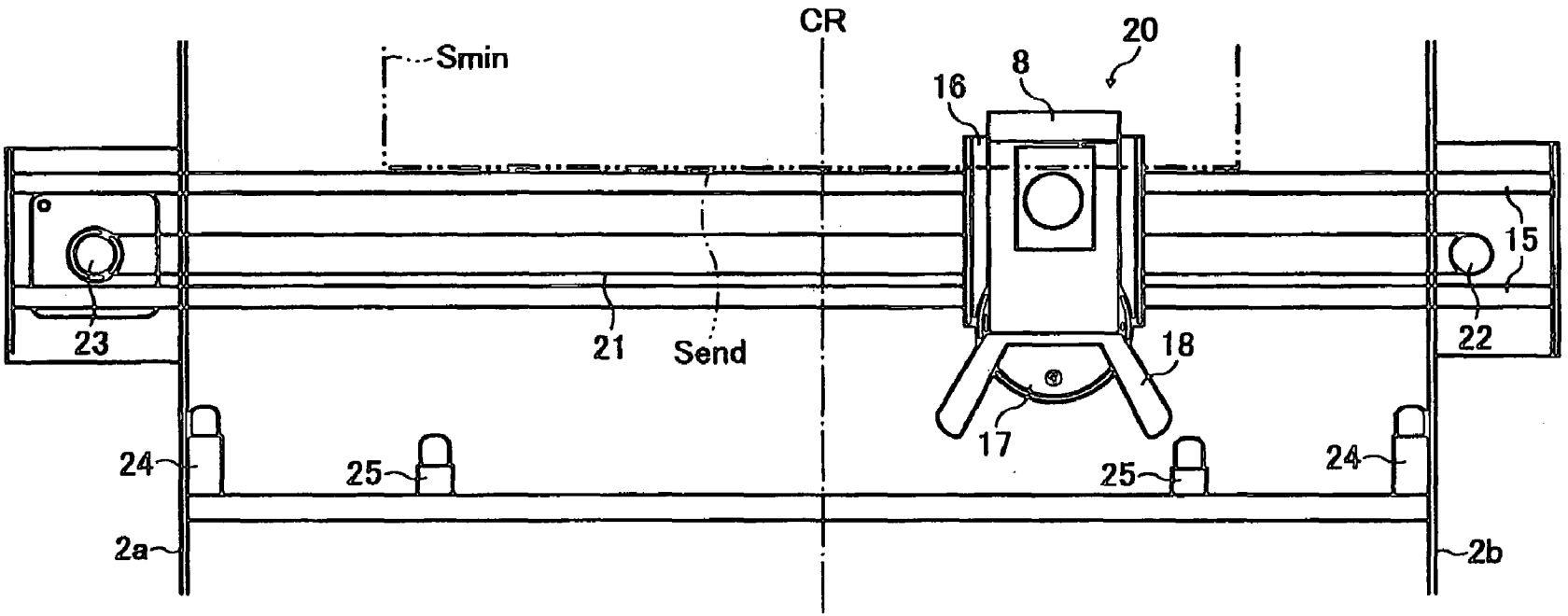
FIG. 18 is a view showing an operation performed to move the stapler from the condition shown in FIG. 17 to a parallel stapling position.

FIG. 14 shows a condition in which the stapler unit 20 is tilted by the pin A 24 on the front side plate 2*a* side. From this state, when the stapler unit 20 in the oblique stapling condition moves from the front side to the back side (in the direction of an arrow D), as shown in FIG. 15, the lever 18 comes into contact with the pin B 25 so as to rotate, as shown in FIG. 16, thereby causing the gear 17 to rotate. The sector gear 19 rotates in accordance therewith, and as a result, the stapler 8 rotates. At the point where the stapler 8 returns to the parallel stapling condition, as shown in FIG. 17, the lever 18 becomes separated from the pin B 25, and as a result, the stapler 8 is maintained in the parallel stapling condition. In this state, the stapler unit 20 advances directly, as shown in FIG. 18, or moves in the opposite direction to the predetermined position for performing stapling processing, whereupon stapling processing is performed. In cases where parallel stapling is to be performed in a plurality of locations, the stapler unit 20 is capable of advancing directly to a predetermined position while in the state shown in FIG. 18, and thus stapling processing can be performed in a desired position of the sheet member S while maintaining the stapler unit 20 in the parallel stapling condition.

Figure 19:
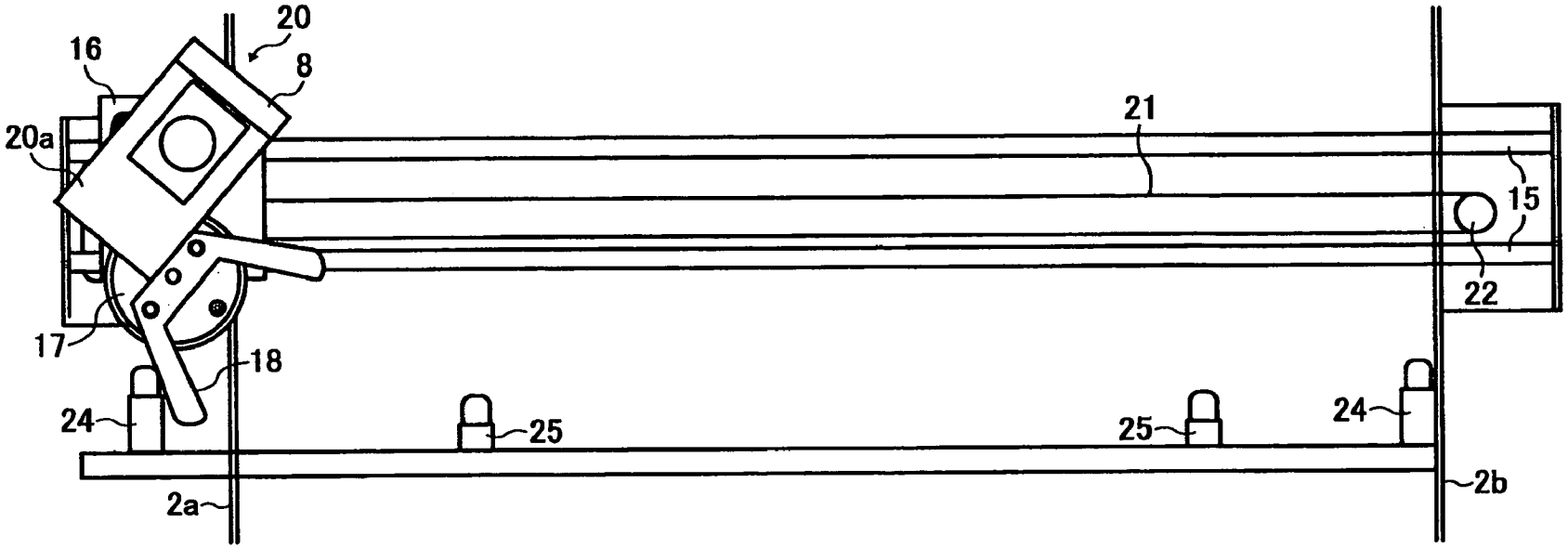
FIG. 19 is a view showing an example in which the staple unit is moved diagonally on the front side of the front side plate to facilitate staple replenishment.

As regards staple replenishment in the stapler 8, a structure in which staple replenishment can be performed from the outside of the side plate of the apparatus is preferable in terms of user-friendliness. Therefore, as shown in FIG. 19, the pin A 24 on the front side plate side is positioned further to the front side than the front side plate 2*a* such that the stapler 8 is rotated on the front side of the sheet processing apparatus 2 and held on standby in this position. In so doing, a cartridge 20*a* storing replenishment staples can be attached and detached without interfering with peripheral members. Moreover, by moving the stapler 8 to a tilted state in front of the front side plate 2*a*, the staple replenishment operation can be performed easily on the front surface side of the sheet processing apparatus 2.

Other members, for which no specific description has been provided, are structured identically to those of the first embodiment described above, and possess identical functions.

According to this embodiment, effects such as the following are obtained.

1) Both parallel stapling and oblique stapling can be performed on the sheet member using a single drive source, thereby suppressing increases in the number of components and preventing increases in the weight of the machine. As a result, a reduction in cost can be achieved.

2) The stapler moves and rotates in a substantially vertical plane, thereby enabling space conservation. As a result, increases in the size of the machine, particularly in the width direction, can be suppressed, enabling a reduction in size, and as a result, increases in the surface area required for the machine can be prevented.

Third Embodiment

In the second embodiment, the attitude of the staple unit 20 for performing parallel stapling and oblique stapling is controlled by moving the staple unit 20 along the guide rods 15. By performing control in this manner, parallel stapling and oblique stapling can be performed with a simple structure. However, the attitude of the staple unit 20 is maintained merely by friction between the gear 17 and sector gear 19 and friction on the periphery of the shafts 17*a*, 19*a*. Maintaining the attitude of the staple unit 20 through frictional force alone does not pose any particular problems, but since the stapler 8 is supported rotatably by the shaft 19*a* and the shaft 19*a* is offset from the center of the stapler 8, and since the stapler 8 itself is by no means a light weight component, a gravitational moment often occurs when the stapler 8 is tilted for the purpose of oblique stapling, and as a result, it may become impossible to hold the stapler 8 through frictional force alone. Hence, in this embodiment, a stopper is provided for maintaining the stapler 8 in a tilted state so that the attitude of the stapler 8 can be maintained reliably.

Figure 20:
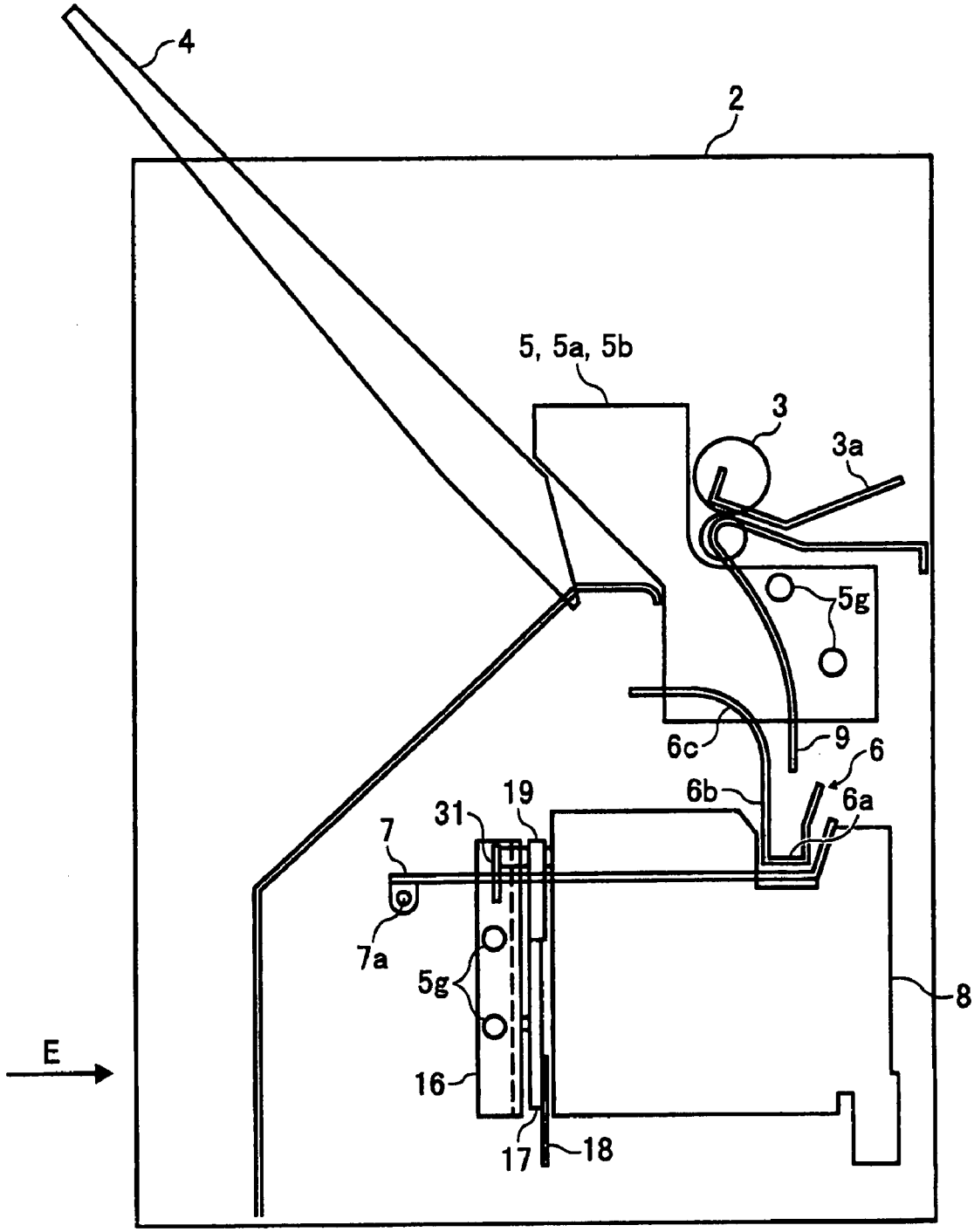
FIG. 20 is a view showing the schematic structure of a sheet processing apparatus according to a third embodiment of the present invention.
Figure 21:
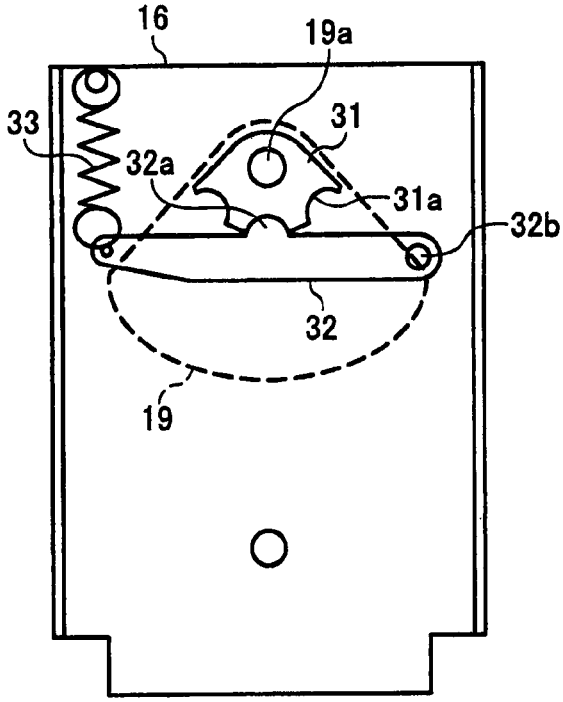
FIG. 21 is a view of a pedestal part of the sheet processing apparatus, seen from the direction of an arrow E.

FIG. 20 shows the structure of the sheet processing apparatus 2 according to the third embodiment, and FIG. 21 shows the structure of a stopper. As is evident from FIGS. 20 and 21, a stopper 31 is attached to the rotary shaft 19*a* of the sector gear 19 so as to rotate integrally with the stapler 8 and sector gear 19. Concave forms 31*a* for limiting the position of the stapler 8 are provided on the outer peripheral portion of the stopper 31, and these concave forms 31*a* engage respectively with a convex portion 32*a* of a rotation-stopping arm 32 provided separately so as to limit the rotation of the stopper 31. One end of the rotation-stopping arm 32 is attached rotatably to the pedestal 16 via a shaft 32*b*. A tension spring 33 is attached to the other end of the rotation-stopping arm 32 so as to extend between the rotation-stopping arm 32 and the pedestal 16. In FIG. 21, the rotation-stopping arm 32 is biased elastically in a clockwise direction at all times. Note that FIG. 21 shows the parallel stapling condition, in which the convex form 32*a* of the rotation-stopping arm 32 is fitted into a central concave form 31*a* to limit the position of the stapler 8. Also note that the convex portion 32*a* and concave forms are preferably formed from members having a sliding-resistant property or members that have been subjected to sliding resistance processing.

Figure 22:
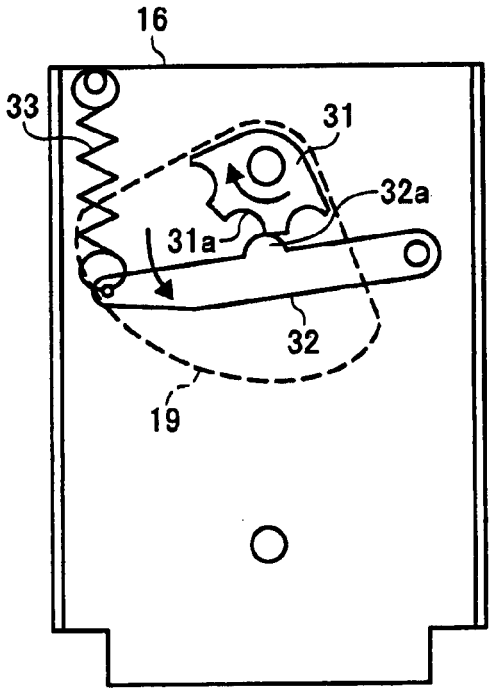
FIG. 22 is a view showing an operation performed to rotate the stapler in an oblique stapling direction from the condition shown in FIG. 21.
Figure 23:
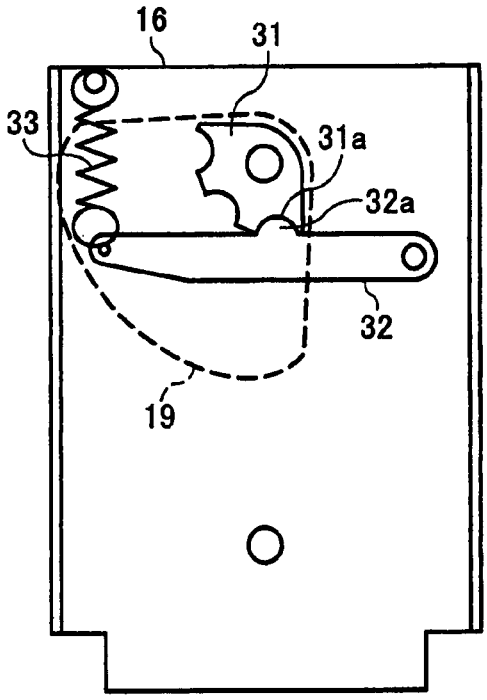
FIG. 23 is a view showing an operation performed to rotate the stapler further from the condition shown in FIG. 22 to the oblique stapling condition.

FIGS. 22 and 23 show an operation performed when moving from the condition shown in FIG. 21 to the oblique stapling condition, this operation corresponding to the operation shown in FIGS. 11A and 11B. When the lever 18 moves from the parallel stapling condition shown in FIG. 20 and comes into contact with the pin A 24 so as to shift to the oblique stapling condition, as shown in FIG. 11B, the concave form 31*a* in the central portion of the stopper 31 and convex form 32*a* of the rotation-stopping arm 32, which are fitted together during parallel stapling, are disengaged, as shown in FIG. 22, whereupon the convex portion 32*a* of the rotation-stopping arm 32 is fitted into a concave form 31*a* formed in the side portion, as shown in FIG. 23. As a result, the oblique stapling condition is maintained. Note that FIG. 22 shows a condition in which the tension spring 33 is extended such that the convex form 32*a* is caused to slide along the outer peripheral surface of the stopper 31 by the elastic force of the tension spring 33, thereby moving along the part of the stopper 31 between adjacent concave forms 31*a*. A similar operation is performed during oblique stapling in the opposite direction.

With this structure, the respective concave forms 31*a* of the stopper 31 and the convex form 32*a* of the rotation-stopping arm 32 fit together such that the stapler 8 can be held in the parallel stapling condition and the oblique stapling condition securely.

Figure 24:
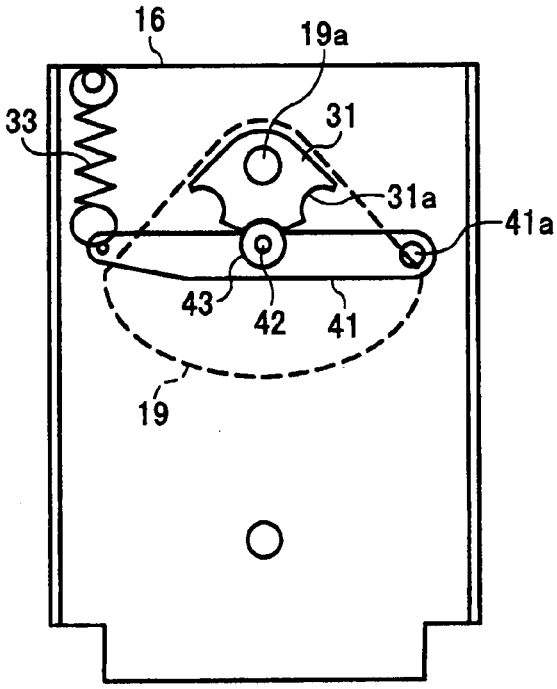
FIG. 24 is a view of a pedestal part shown in FIG. 20 seen from the direction of an arrow E in a modified example of the third embodiment.

As shown in FIG. 24, the convex form 32*a* of the rotation-stopping arm 32 may be replaced by a bearing 43, for example. The bearing 43 may be a slide bearing formed from a sliding-resistant material or a ball bearing. In this embodiment, a shaft 42 is provided in a position corresponding to the part of a rotation-stopping arm 41 not comprising the convex form 32*a* in which the 32*a* would be formed, and the bearing 43 is attached rotatably to the shaft 42. All other structures are identical to those shown in FIG. 20. Note that the rotation-stopping arm 41 is attached rotatably to a shaft 41*a* provided on the pedestal 16.

Figure 25:
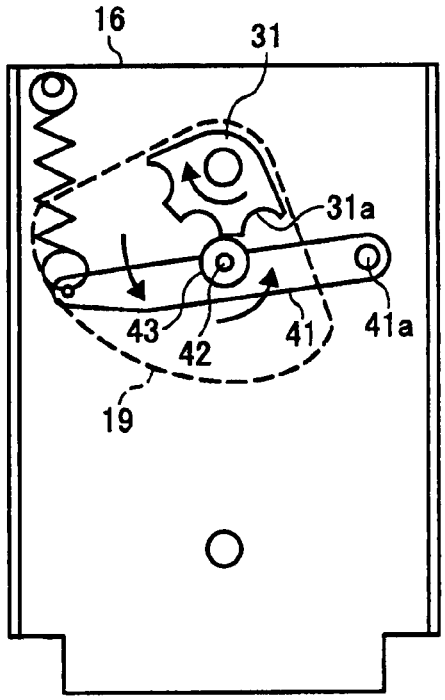
FIG. 25 is a view showing an operation performed to rotate the stapler in the oblique stapling direction from the condition shown in FIG. 24.
Figure 26:
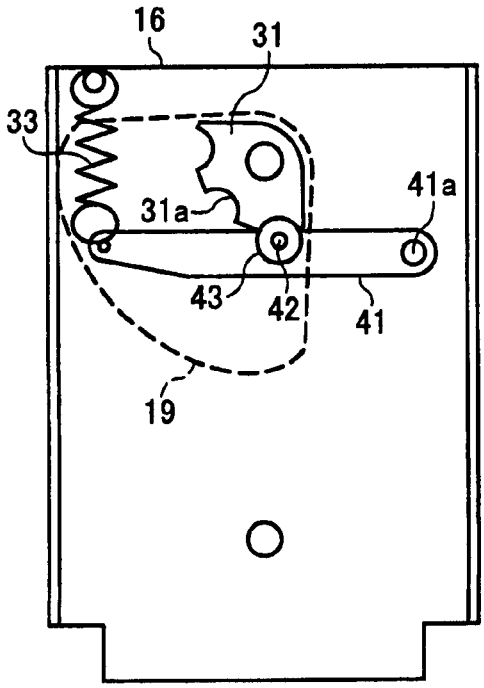
FIG. 26 is a view showing an operation performed to rotate the stapler further from the condition shown in FIG. 25 to the oblique stapling condition.

With this structure, as shown in FIGS. 25 and 26, the bearing 43 passes along the convex portion between adjacent concave forms 31*a* and fits into the side portion concave form 31*a* such that the stapler 8 enters the oblique stapling condition. Thus, the oblique stapling condition can be maintained. A similar operation is performed during oblique stapling in the opposite direction.

In this modified example, the force required to rotate the stapler 8 can be reduced in comparison with the embodiment shown in FIG. 21, and moreover, abrasion caused by friction does not occur. Therefore, an improvement in reliability can be achieved over the embodiment shown in FIG. 21.

Figure 27:
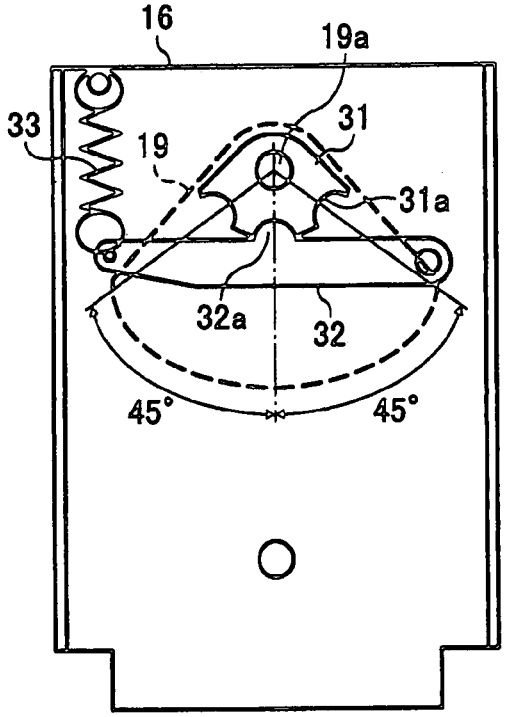
FIG. 27 is a view showing a condition of 45° oblique stapling in the example of FIG. 21.
Figure 28:
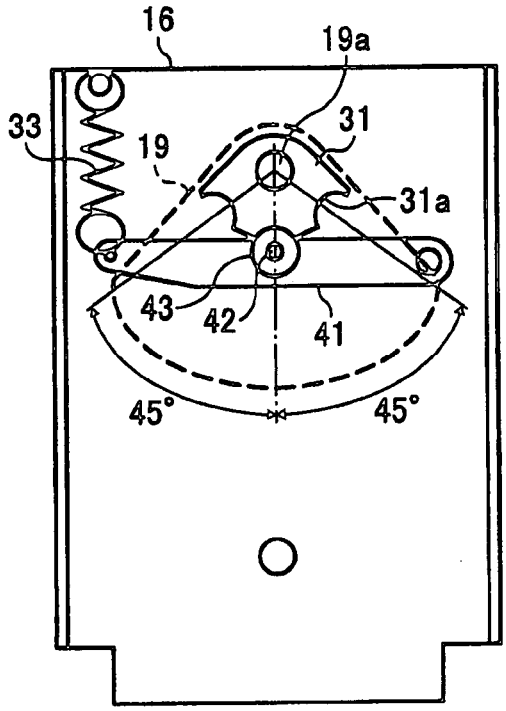
FIG. 28 is a view showing a condition of 45° oblique stapling in the example of FIG. 24.

Furthermore, the concave forms 31*a* for defining the oblique stapling position are set such that the stapler 8 takes an angle of 45° to the end portion of the sheet member S, as shown in FIGS. 27 and 28. Thus, the stapler 8 is rotated to an angle of 45°, which is the optimum angle for oblique stapling, and the stapler 8 can be held securely in this position.

Other members, for which no specific description has been provided, are structured identically to those of the first and second embodiments described above, and possess identical functions.

According to this embodiment, effects such as the following are obtained.

1) During oblique stapling, the weight of the stapler 8 can be supported such that the attitude of the stapler 8 can be maintained securely, and therefore the position of the staple in relation to the sheet member can be secured with stability.

2) The convex form 32*a* is formed integrally with the rotation-stopping arm 32 and fitted into the respective concave forms 31*a* of the stopper 31. As a result, the attitude of the stapler 8 can be maintained securely and at low cost.

3) When the bearing 43 is provided on the rotation-stopping arm 32 in place of the convex form 32*a*, the bearing 43 rotates the protruding part of the stopper 31. Thus, the sliding resistance load can be lightened, increases in the load over time and noise generation can be reduced, and problems such as premature deterioration of structural members due to abrasion can be prevented.

4) The stapler 8 can be set (fixed) in a position of 45° for the purpose of oblique stapling, and can therefore respond to 45° oblique stapling, which is required by many users and therefore employed frequently.

Fourth Embodiment

Figure 29:
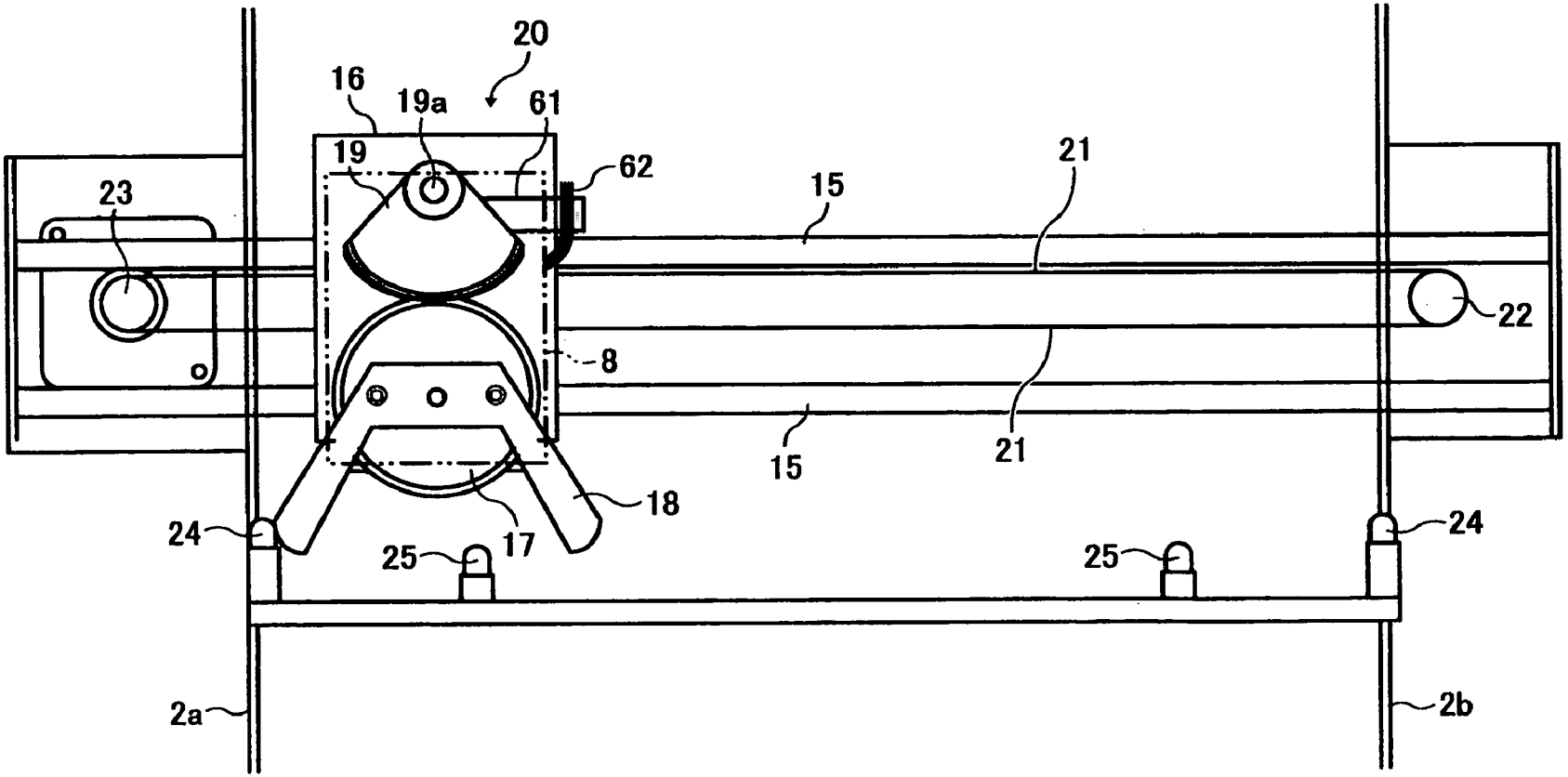
FIG. 29 is a view showing the structure of a movement mechanism in a stapler unit of a sheet processing apparatus according to a fourth embodiment of the present invention.

The stapler 8 moves in an orthogonal direction to the conveyance direction of the sheet member S and also rotates to the left and right for the purpose of oblique stapling. As a result, it is difficult to wind a harness onto a motor for operating the stapler 8. The reason for this is that when the load on the harness is large, the harness may break at a joint portion joining the harness to a circuit board. Hence, in this embodiment, a harness is attached to the sector gear 19 that rotates integrally with the stapler 8. FIG. 29 shows the staple unit 20 according to the fourth embodiment and a movement mechanism thereof. As is evident from the drawing, an extending member 61 is provided integrally with, and so as to protrude from, the side portion of the sector gear 19, and a stapler harness 62 extending from the stapler 8 is bound and fixed to the extending member 61.

Figure 30A:
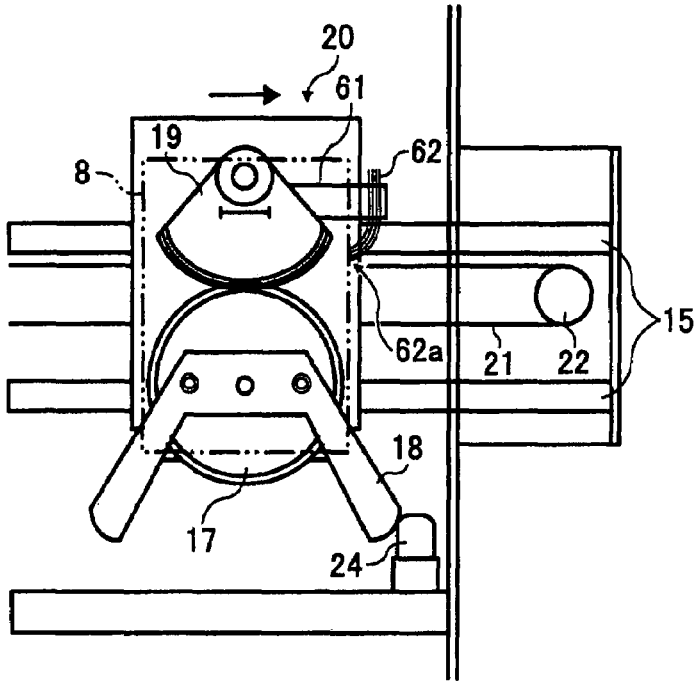
FIGS. 30A and 30B are views showing a relationship between a stapler harness and a stapler during rotation of the stapler in the stapler unit.
Figure 30B:
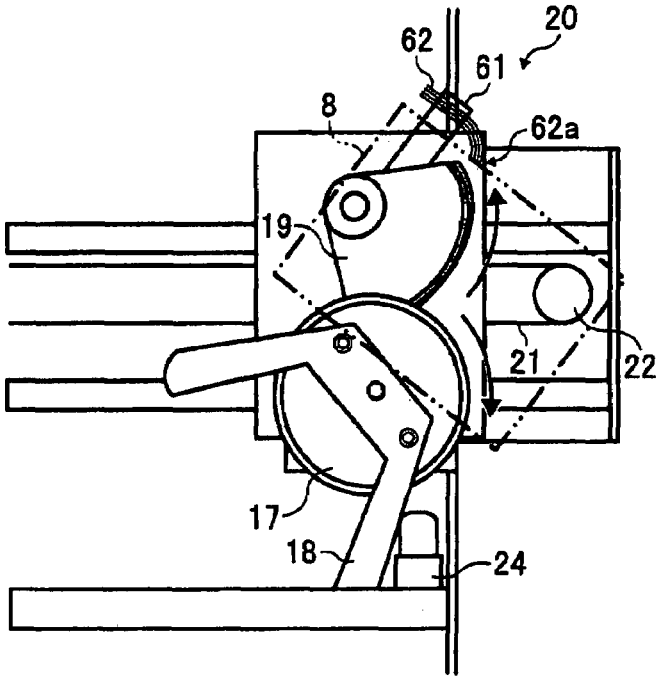

With this structure, as shown in FIG. 30A, when the staple unit 20 performs parallel stapling or moves in parallel, the stapler harness 62 is fixed to the extending member 61, and therefore a joint portion 62*a* joining the stapler harness 62 to the circuit board is maintained in a fixed attitude and no stress occurs. Even when the stapler 8 is rotated from the state shown in FIG. 30A to the oblique stapling condition shown in FIG. 30B, the joint portion 62*a* joining the stapler harness 62 to the circuit board is maintained in a fixed attitude, and no stress occurs. Hence, in either of the cases shown in FIGS. 30A and 30B, there is no danger of the stapler harness 62 bending and breaking.

Figure 31:
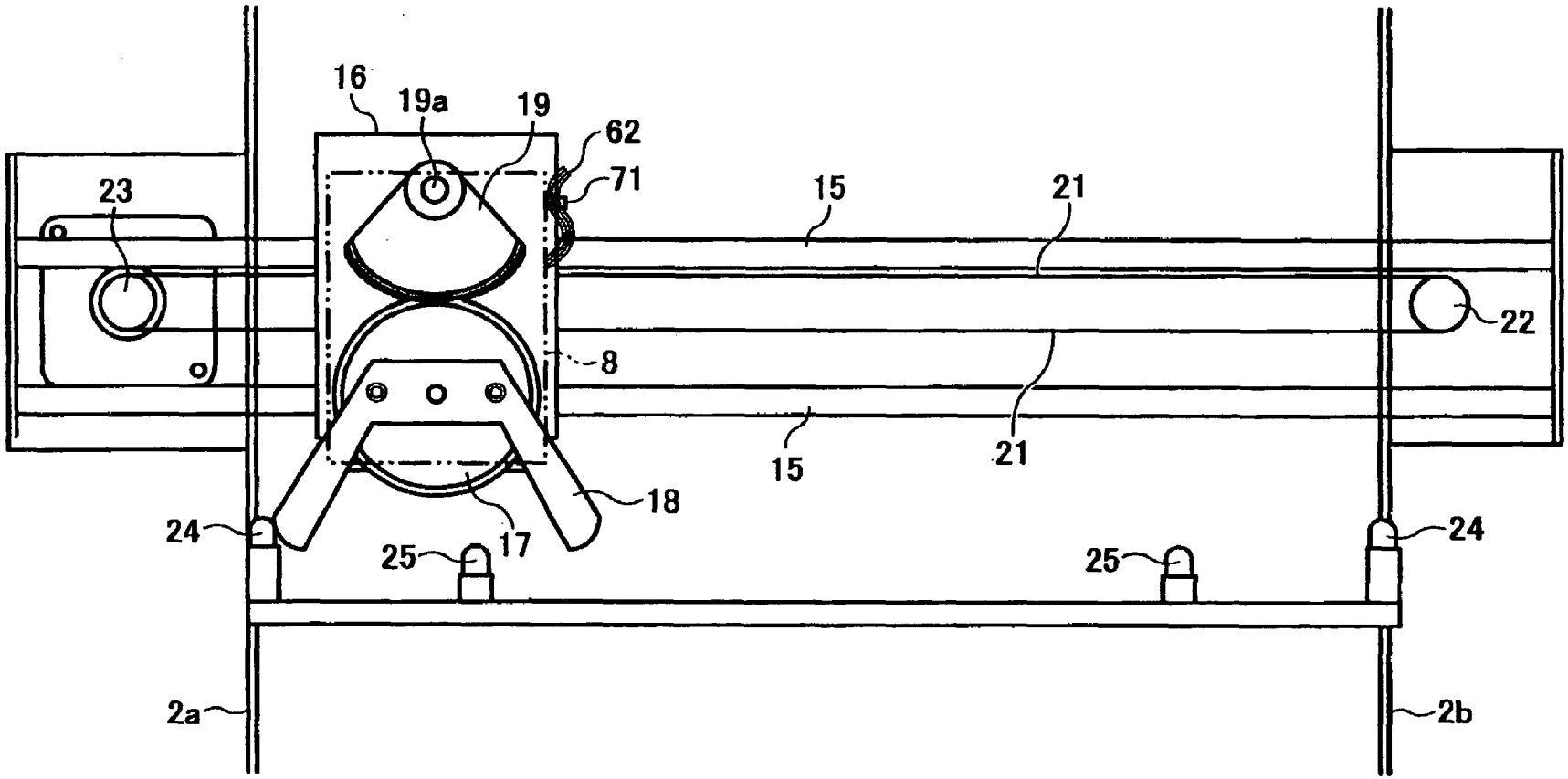
FIG. 31 is a view showing the movement mechanism of the stapler unit according to a modified example of the fourth embodiment.

In the embodiment shown in FIG. 29, the extending member 61 protrudes from the sector gear 19, which moves and rotates integrally with the stapler 8, and the stapler harness 62 is fixed to the extending member 61. However, the stapler harness 62 may be fixed to the stapler 8 itself. This modified example is shown in FIG. 31. FIG. 31 is a view showing an example in which a clamp 71 is provided on a side portion of the stapler 8, and the stapler harness 62 is bound and fixed to the clamp 71.

Figure 32A:
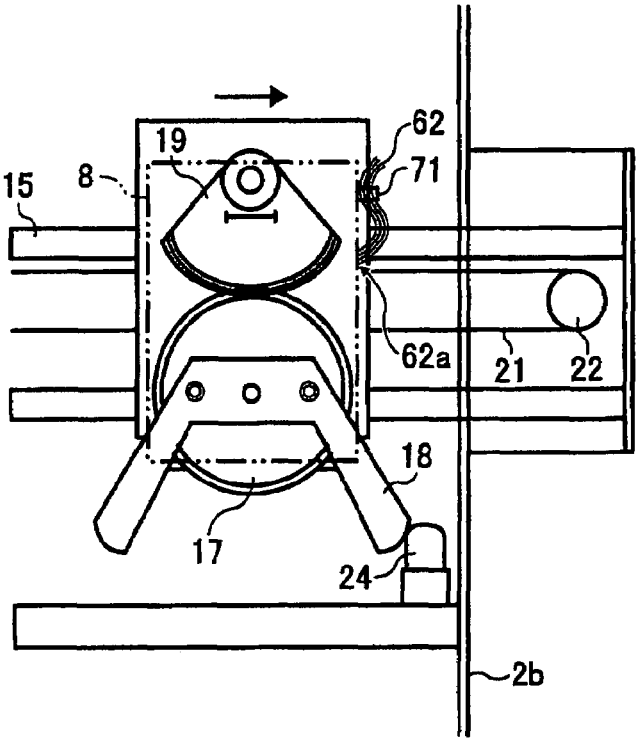
FIGS. 32A and 32B are views showing the relationship between the stapler harness and the stapler during rotation of the stapler according to the modified example of the fourth embodiment.
Figure 32B:
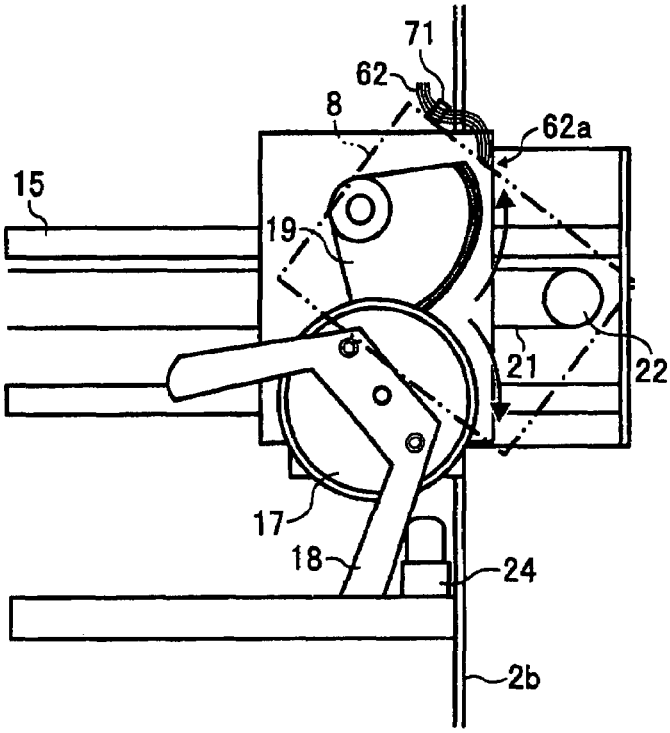

With this structure, as shown in FIG. 32A, when the staple unit 20 performs parallel stapling or moves in parallel, the stapler harness 62 is fixed to the clamp 71, and therefore the joint portion 62*a* joining the stapler harness 62 to the circuit board is maintained in a fixed attitude and no stress occurs. Even when the stapler 8 is rotated from the state shown in FIG. 32A to the oblique stapling condition shown in FIG. 32B, the joint portion 62*a* joining the stapler harness 62 to the circuit board is maintained in a fixed attitude, and no stress occurs. Hence, in either of the cases shown in FIGS. 32A and 32B, there is no danger of the stapler harness 62 bending and breaking.

Note that the decision regarding whether to bind the stapler harness 62 to the stapler 8 (stapling means) or to the sector gear 19 that moves and rotates together with the stapler 8 may be made according to the machine structure and the thickness of the electrical harness (the number of bound harnesses).

Other members, for which no specific description has been provided, are structured identically to those of the first and second embodiments described above, and possess identical functions.

According to this embodiment, the stapler harness (electrical harness) 62, which is connected to the circuit board of the stapler 8, moves and rotates in accompaniment with the movement and rotation operations of the stapler 8. Therefore, the stapler harness 62 does not bend. As a result, breakage of the stapler harness 62 due to a repeated physical load on the joint portion 62*a* joining the stapler harness 62 to the circuit board does not occur, and malfunctions, breakdowns, and so on caused by such breakage are avoided.

According to the first through fourth embodiments of the present invention, when aligning the sheet member, the stapling direction of the sheet stapling means is set parallel to a contact surface of a first support member which contacts the end portion of the sheet member on the upstream side of the sheet member conveyance direction. Hence, the apparatus can be reduced in size, enabling space conservation and excellent stapling quality.

Fifth Embodiment

Figure 33A:
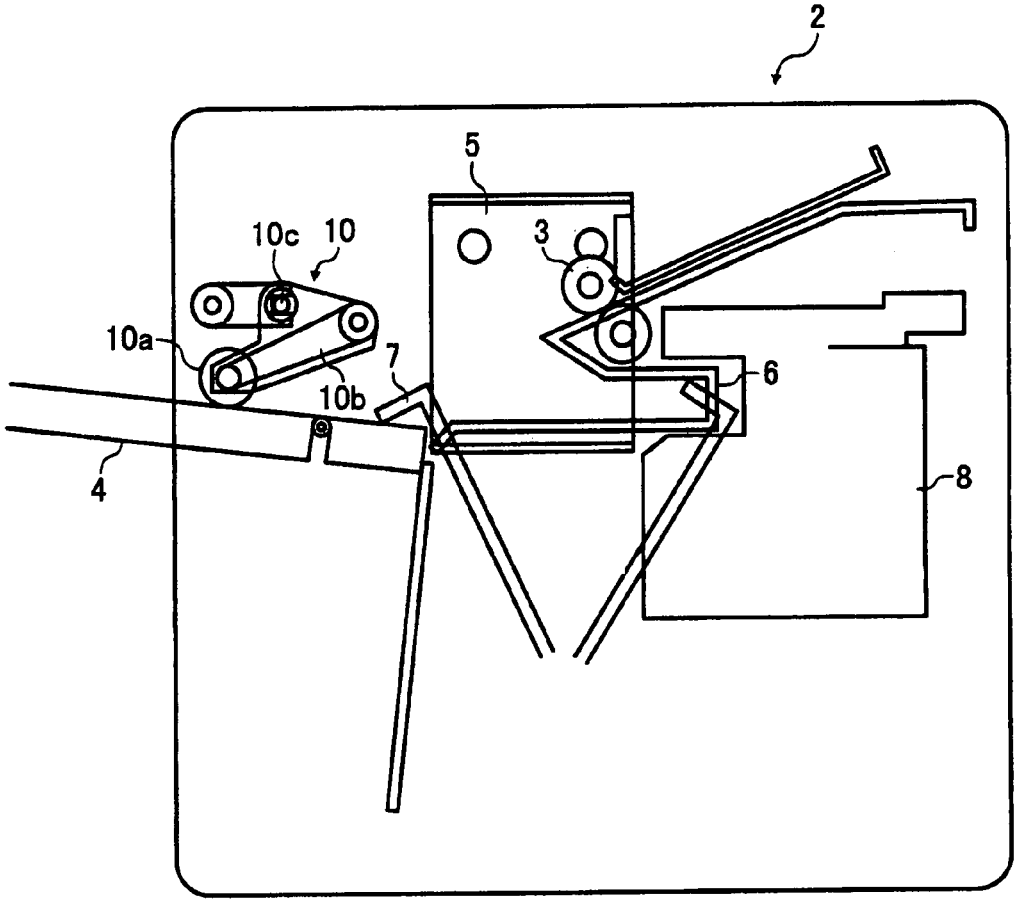
FIGS. 33A and 33B are views showing the schematic structure of a sheet processing apparatus according to a fifth embodiment of the present invention.
Figure 33B:
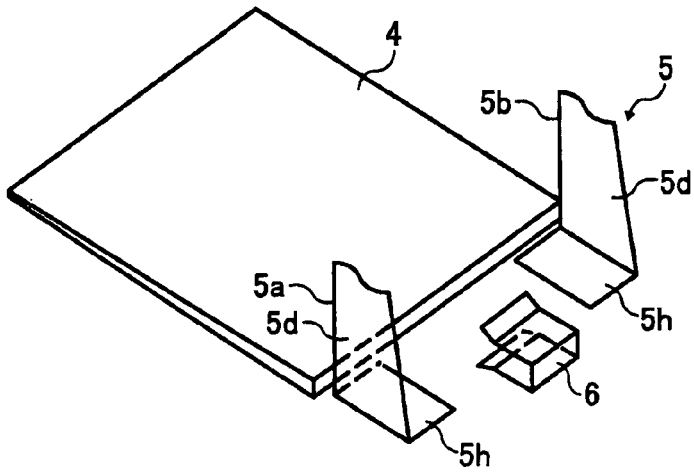

FIGS. 33A and 33B show the schematic structure of the sheet processing apparatus 2 and jogger 5 of this embodiment. In FIG. 33A, the sheet processing apparatus 2 comprises the inlet roller 3, the discharge tray 4, a return roller 10, the jogger 5, the rear end fence 6, the stapler 8, and the discharge link 7. A sheet member discharged by the image forming apparatus 1 is conveyed into the sheet processing apparatus 2 and then discharged onto the discharge tray 4 or a sheet member loading portion of the jogger 5.

The return roller 10 is provided facing a sheet member carrying surface of the discharge tray 4, and is constituted by a roller 10*a* for conveying the sheet member and an arm 10*b* for supporting the roller 10*a*. The arm 10*b* is supported rotatably about a rotational center 10*c*. As shown in FIG. 33B, the jogger 5 is constituted by a vertical portion 5*d* that acts on the end surface of the sheet member, and a loading portion 5*h* onto which the sheet member is loaded. The front jogger 5*a* for aligning the front side of the sheet member and the rear jogger 5*b* for aligning the rear side of the sheet member a re provided as a pair.

The rear end fence 6 is used to align the rear end (rear end portion Send) of the sheet member in the sheet member conveyance direction. Having been discharged onto the discharge tray 4 or jogger 5, the sheet member is conveyed in an opposite direction to the discharge direction by the return roller 10 such that the end portion Send thereof impinges on the rear end fence 6, and thus an alignment operation is performed. The stapler 8 is disposed in the vicinity of the rear end fence 6, and performs stapling processing near the rear end Send of the sheet member aligned by the rear end fence 6. Note that FIG. 33B shows only the part of the rear end fence 6 that comes into contact with the sheet member. The discharge link 7 functions to move the sheet member onto the discharge tray 4 after the sheet member has been loaded onto the discharge tray 4 and jogger 5 and then caused to impinge on the rear end fence 6, and is operated by a link mechanism not shown in the drawing.

Note that the second embodiment, described above with reference to FIGS. 10A through 19, may be applied to this embodiment, and hence repeated description thereof has been omitted.

Sixth Embodiment

In the fifth embodiment described above, the attitude of the staple unit 20 for performing parallel stapling and oblique stapling is controlled by moving the staple unit 20 along the guide rods 15. By performing control in this manner, parallel stapling and oblique stapling can be performed with a simple structure. However, the attitude of the staple unit 20 is maintained merely by friction between the gear 17 and sector gear 19 and friction on the periphery of the shafts 17*a*, 19*a*. Since the stapling means move and rotate in a horizontal plane, the attitude of the staple unit 20 can be maintained through frictional force alone. This structure is sufficient for normal operations, but depending on the use environment, it may be impossible to ignore the effects of vibration, reactive force during stapling, and so on. Hence, in the sixth embodiment, measures are taken to ensure that the attitude of the staple unit 20 can be maintained securely.

Figure 34B:
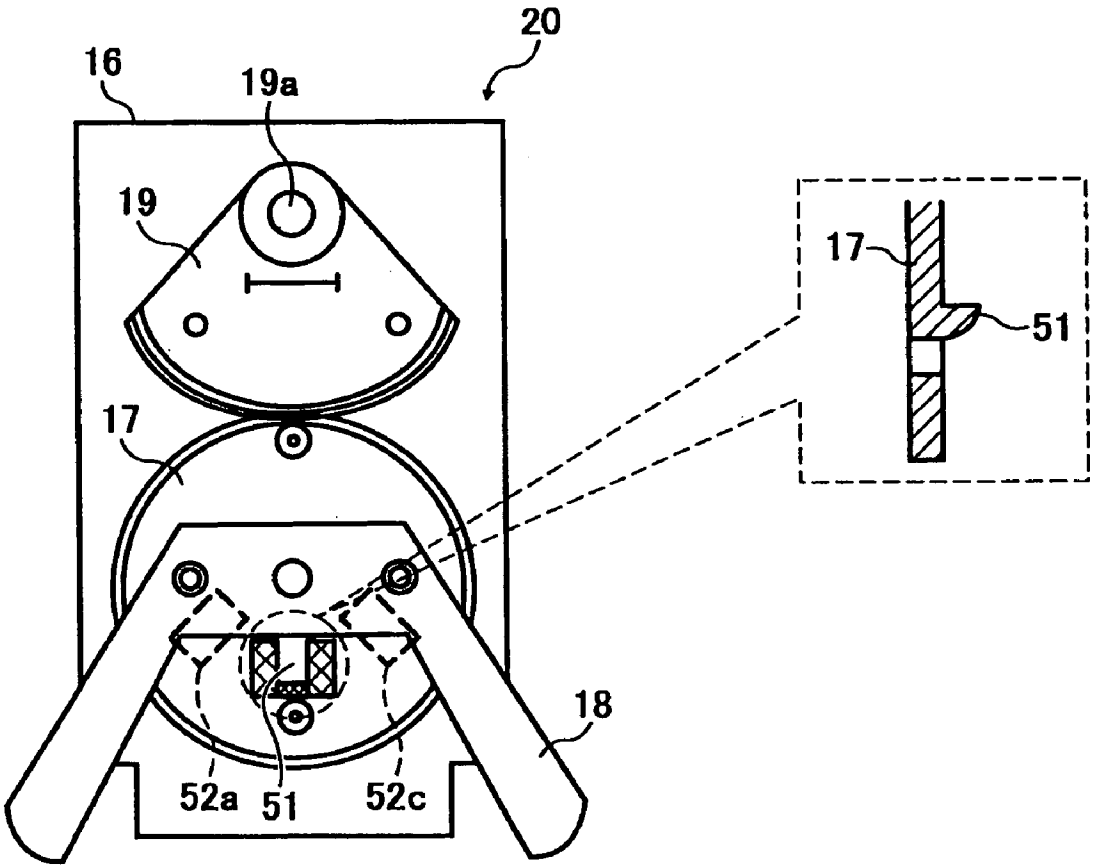
FIGS. 34A and 34B are views showing the structure of a stapler unit according to a sixth embodiment of the present invention.
Figure 34A:
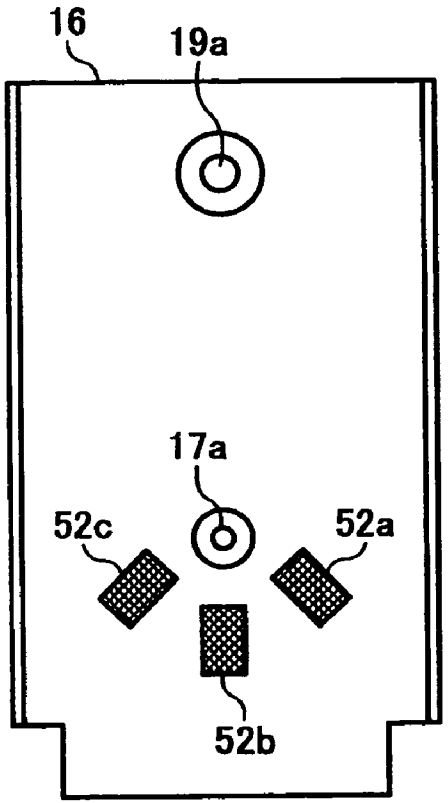

FIGS. 34A and 34B show the structure of the staple unit 20 according to this embodiment. In FIGS. 34A and 34B, three engaging holes 52*a*, 52*b*, 52*c* (to be referred to together using the reference numeral 52 hereafter) are drilled into the pedestal 16, and an engaging hook 51 that engages with one of the engaging holes 52*a*, 52*b*, and 52*c* elastically is provided on the gear 17. Of the engaging holes, the engaging hole 52*a* is used for front oblique stapling, the engaging hole 52*b* is used for parallel stapling, and the engaging hole 52*c* is used for back oblique stapling. By engaging with one of the engaging holes 52*a*, 52*b*, 52*c*, the engaging hook 51 fixes the stapler 8 in a corresponding position.

Figure 35:
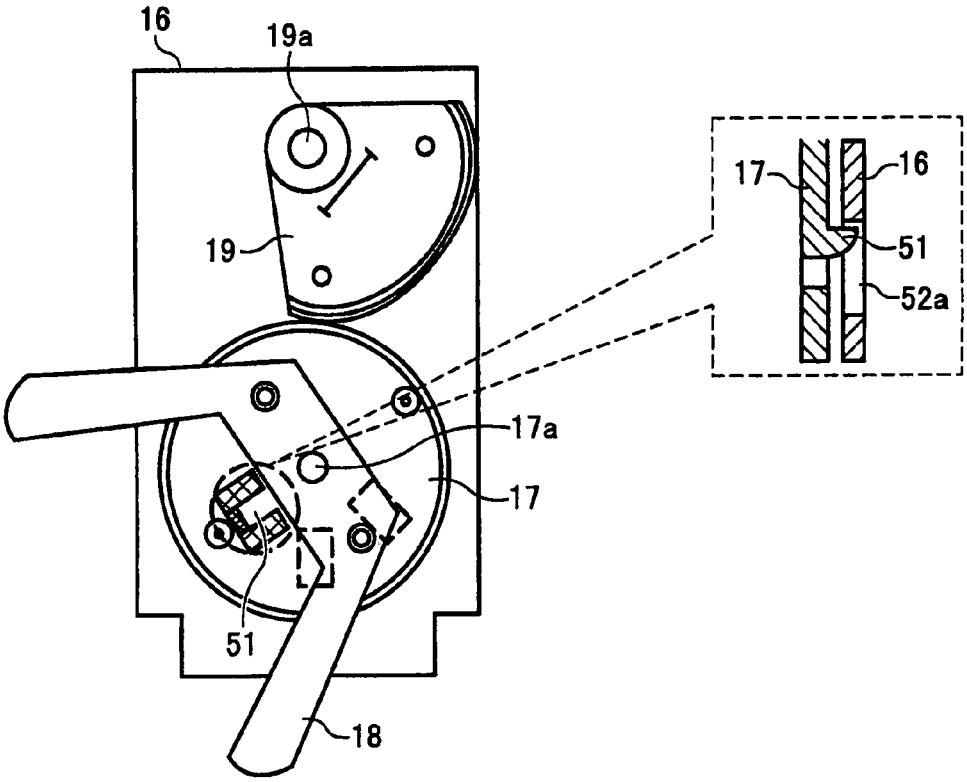
FIG. 35 is a view showing a relationship between a gear and an engaging hook when front oblique stapling is performed by the stapler unit.
Figure 36:
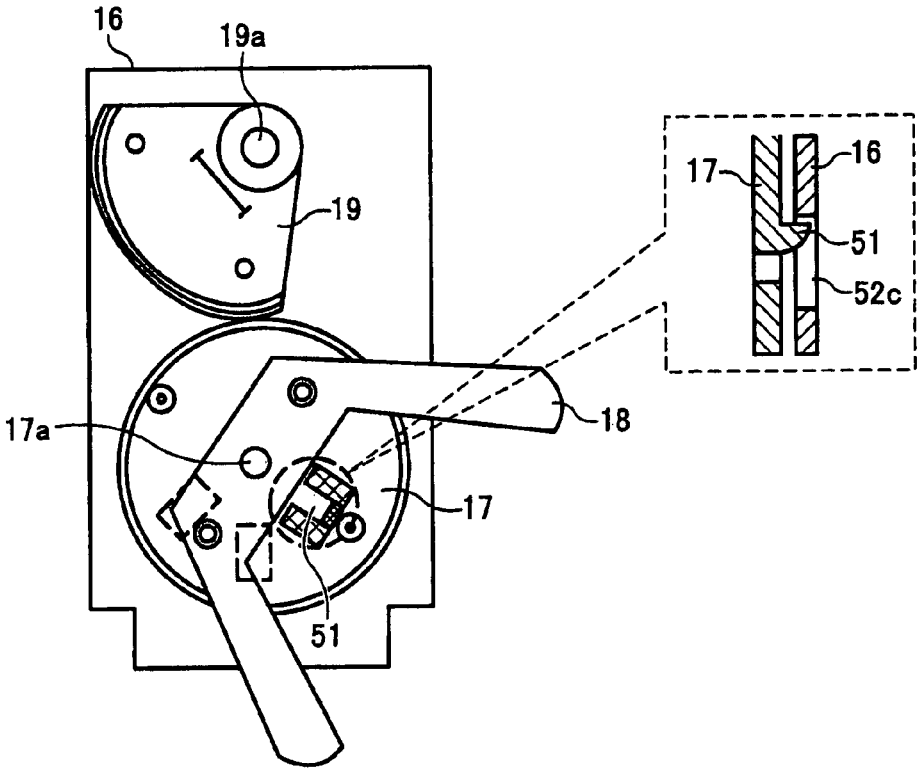
FIG. 36 is a view showing the relationship between the gear and the engaging hook when back oblique stapling is performed by the stapler unit.
Figure 37:
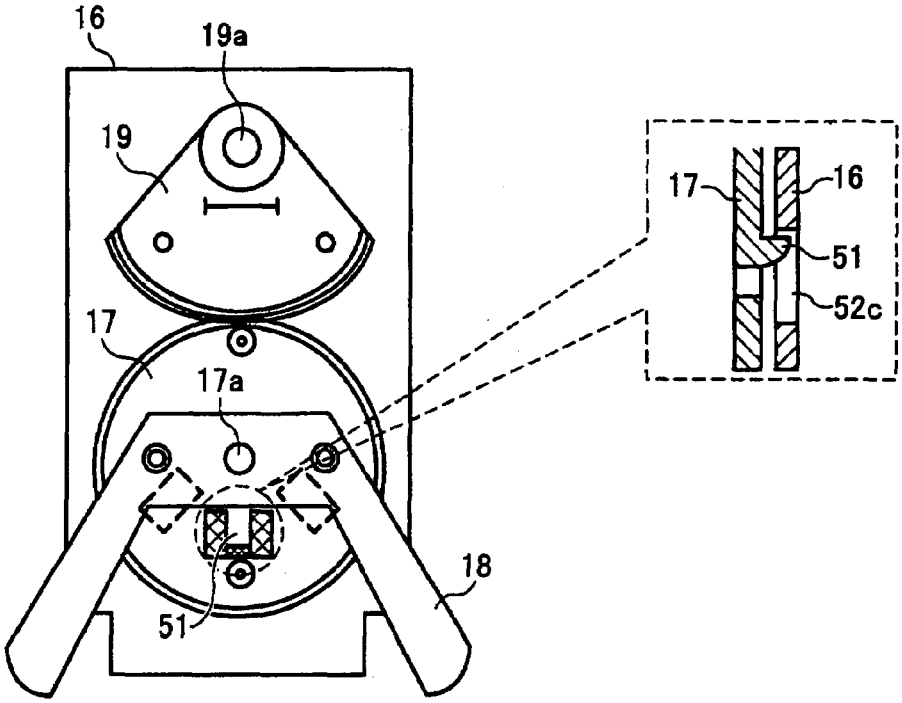
FIG. 37 is a view showing the relationship between the gear and the engaging hook when parallel stapling is performed by the stapler unit.
Figure 38:
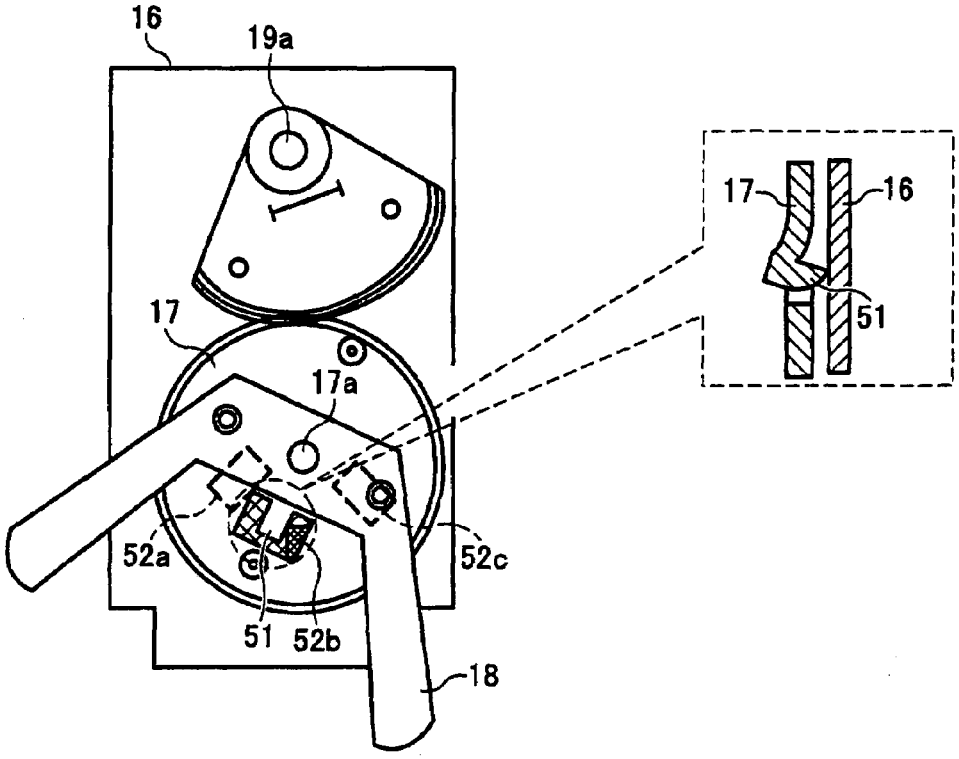
FIG. 38 is a view showing a relationship between the engaging hook and an engaging hole during an operation in which a gear lever contacts a pin A or a pin B while the stapler is moved in parallel, thereby altering the attitude of the stapler.

FIG. 35 shows front oblique stapling in which the engaging hook 51 engages with the front oblique stapling engaging hole 52*a* in the pedestal 16. FIG. 36 shows back oblique stapling in which the engaging hook 51 engages with the back oblique stapling engaging hole 52*c* in the pedestal 16. FIG. 37 shows parallel stapling in which the engaging hook 51 engages with the parallel stapling engaging hole 52*b*. FIG. 38 shows the relationship between the engaging hook 51 and the engaging holes 52*a*, 52*b*, 52*c* during an operation in which the stapler 8 moves in parallel such that the lever 18 of the gear 17 abuts against the pin A 24 or the pin B 25, thereby altering the attitude of the stapler 8. The engaging hook 51 becomes disengaged from the engaging hole 52 and bends back, and as the stapler 8, gear 17, and sector gear 19 rotate, the engaging hook 51 slides over the surface of the pedestal 16. Following this movement, the engaging hook 51 engages elastically with another engaging hole 52, thereby fixing the attitude of the stapler 8 and holding the stapler 8 in the corresponding condition.

Figure 39A:
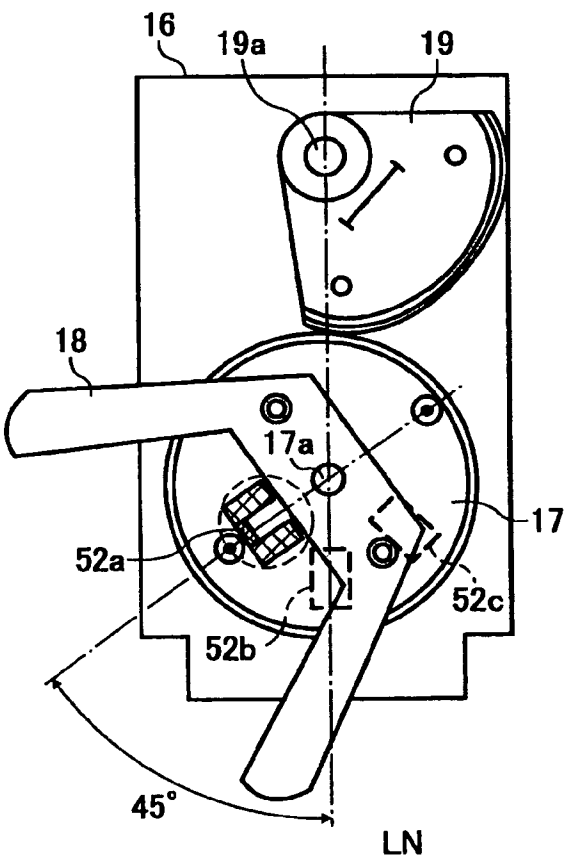
FIGS. 39A to 39C are views showing a relationship of a stapler angle during oblique stapling and parallel stapling to the engaging hook and engaging hole.
Figure 39B:
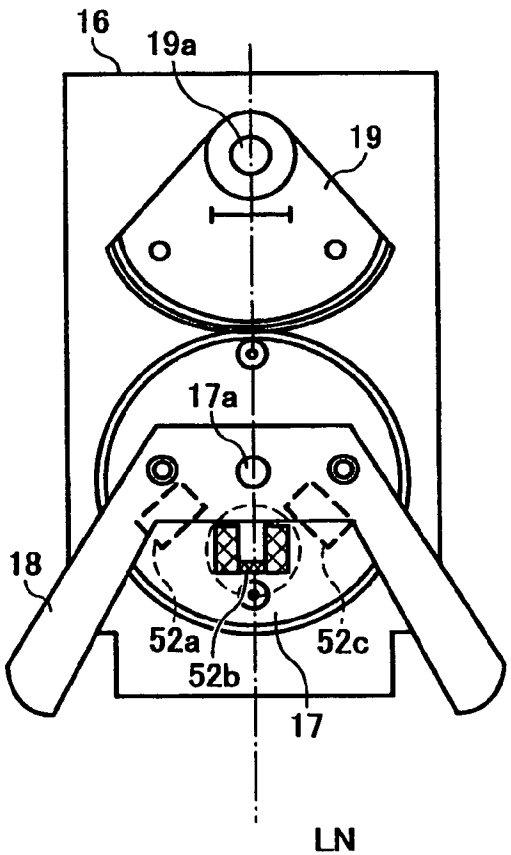
Figure 39C:
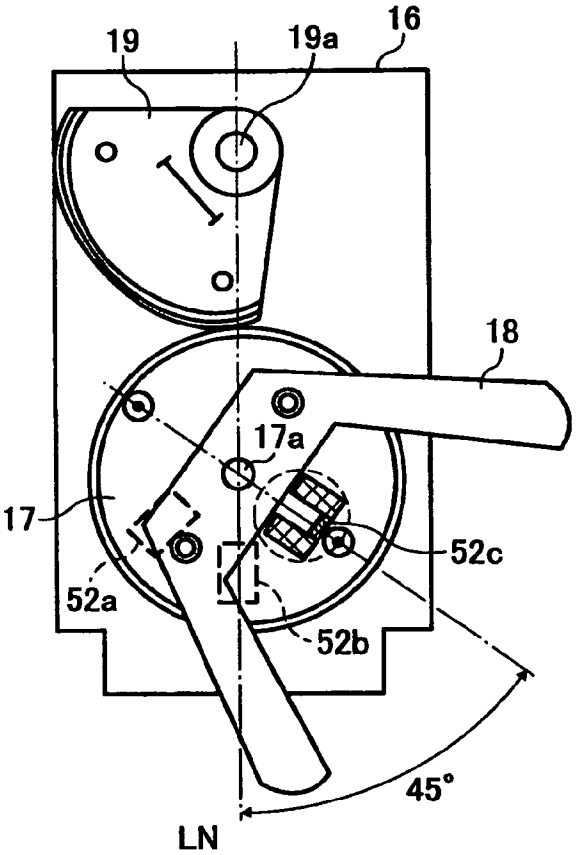

As shown in FIGS. 39A to 39C, when the oblique stapling angle is set at 45°, the engaging hole 52*a* is formed in a position inclined by 45° from a line LN linking the shaft 17*a* and the shaft 19*a* in a clockwise direction (FIG. 39A), the engaging hole 52*c* is formed in a position inclined by 45° from the line LN in a counter-clockwise direction (FIG. 39C), and in the case of parallel stapling, the engaging hole 52*b* is formed on the line LN (FIG. 39B). In other words, the front oblique stapling engaging hole 52*a* and the back oblique stapling engaging hole 52*c* are inclined 45° from the parallel stapling engaging hole 52*b*. This angle is set appropriately in accordance with the angle that is set for oblique stapling. However, a 45° angle of incline is typically selected.

Other members, for which no specific description has been provided, are structured identically to those of the fifth embodiment described above, and possess identical functions. Accordingly, redundant description thereof has been omitted.

In the fifth and sixth embodiments described above, the stapler 8 rotates about the shaft 19*a* when oblique stapling is performed at an angle of 45°, for example, and when parallel stapling is performed, and therefore the stapling position of the staple varies. Hence, the stapling position of the staple in the fifth and sixth embodiments will now be described.

Figure 40:
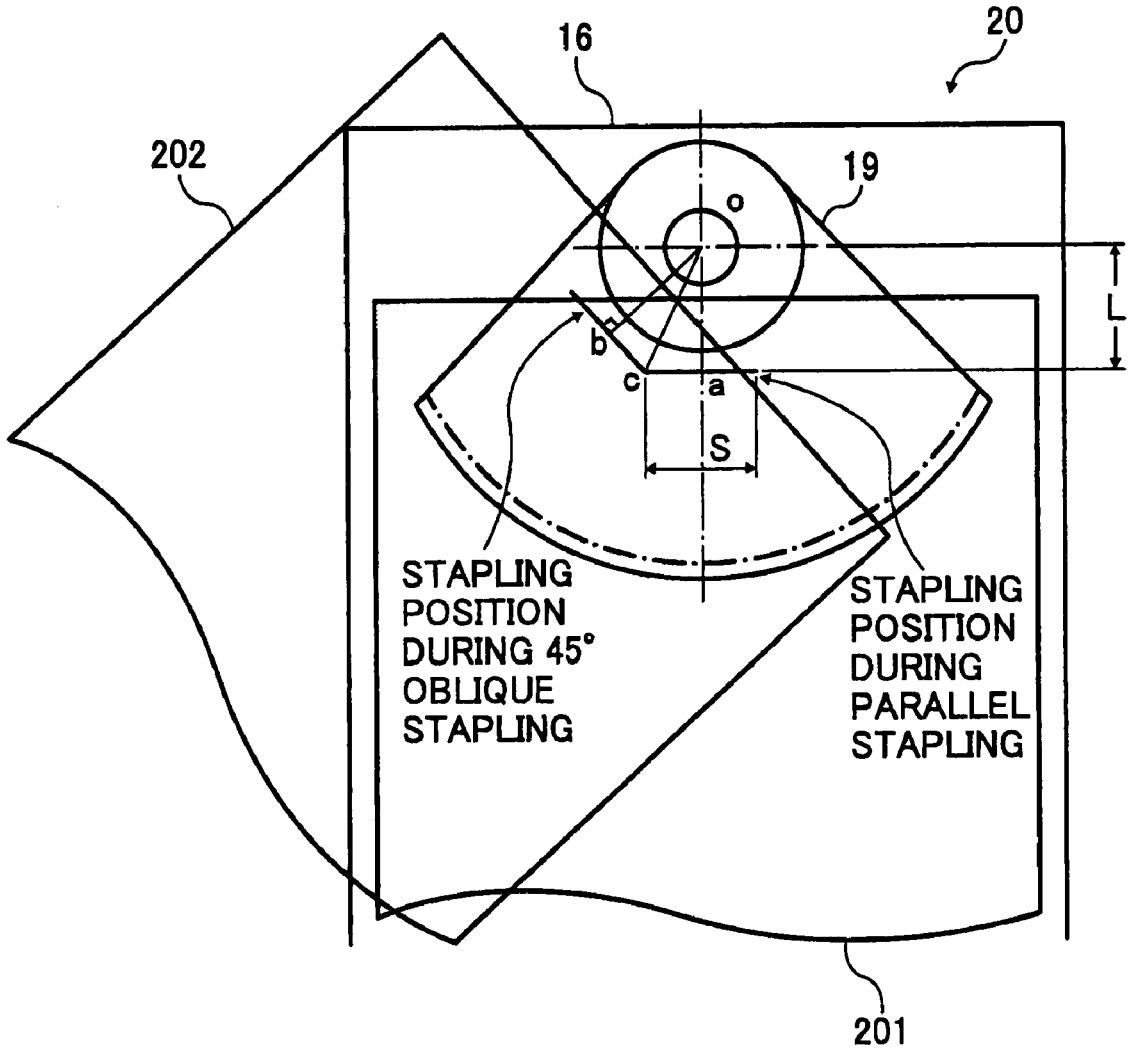
FIG. 40 is a view showing the stapling positions of a staple during oblique stapling and parallel stapling.

FIG. 40 shows the stapling positions of oblique stapling and parallel stapling. The reference numerals 201 and 202 denote the stapler unit 20 in the parallel stapling condition and rotated 45° to the oblique stapling condition, respectively. The sector gear 19 also rotates 45°, but this has been omitted to simplify the drawing. Here, the distance between the stapling position of the stapler 8 and the sector gear 19 is set as L, the width of the staple punched by the stapler 8 is set as S (a constant—a standardized constant dimension), and the rotational center of the sector gear 19 is set as o. In the stapler unit 201 in the parallel stapling condition, a perpendicular is drawn from the rotational center o of the sector gear 19 to the staple, and the intersection thereof is set as a. Likewise in the stapler unit 202 in the oblique stapling condition, a perpendicular is drawn from the rotational center o of the sector gear 19 to the staple, and the intersection thereof is set as b. Further, the staple end portion (in the drawing, the left-hand side end portion) in the parallel stapling position matches the staple end portion (the right-hand side in the drawing) in the oblique stapling position, and this point is set as c.

A triangle oac and a triangle obc are congruent on three sides since side oa=side ob (=L), side ac=side bc (=S/2), and OC is shared. Hence, $$\text{angle aob}=45°,\ \text{angle coa}=\text{angle cob},$$

and therefore, $$\text{angle coa}=\text{angle cob}=\text{angle aob}/2=22.5°$$

Accordingly, $$\tan 22.5°=(S/2)/L,$$

and therefore, $$L=(S/2)/\tan 22.5°\approx 1.2S$$

Hence, by setting the rotational center o of the sector gear 19 in a position that is removed from the staple by a distance of 1.2 times the length S of the staple, the staple end portion positions during parallel stapling and oblique stapling are substantially aligned, and the distance from the sheet member rear end portion Send is substantially identical in parallel stapling and oblique stapling. As a result, a high stapling quality can be obtained. Further, in the case of parallel stapling, stapling processing can be performed in an arbitrary position in the width direction of the paper, and there are no limitations on the number of stapling locations.

According to the embodiment described above, effects such as the following are obtained.

1) When performing parallel stapling or oblique stapling on the sheet member, the stapler can be moved by a single power source in either stapling mode, thereby suppressing increases in the number of components and preventing increases in cost and weight.

2) Both parallel stapling and oblique stapling can be performed on the end portion of the sheet member using a single stapler, and therefore various user operations can be responded to easily.

3) The aforementioned two types of stapling processing can be performed regardless of the size of the sheet member, enabling improvements in product functionality and responsiveness to various user needs.

4) Book binding or the like, in which stapling is performed in two locations, can be performed using a single stapler, enabling improvements in functionality and responsiveness to various user needs.

5) A staple replenishment operation can be performed easily by the user, thereby improving user-friendliness. Moreover, the danger of machine breakage and user injury is eliminated.

6) The stapler can be fixed in the respective attitudes required for parallel stapling and oblique stapling, and the position and attitude of the stapler are not altered by machine vibration, vibration of the stapler itself, and so on. As a result, a staple can be punched in the desired (target) position.

7) The stapler can be set securely in a 45° position for performing oblique stapling, and therefore 45° oblique stapling, which is required by many users and hence employed frequently, can be performed.

8) During oblique stapling, a staple can be punched in an appropriate position of the sheet member, and therefore a situation in which the staple becomes dislodged during use of the sheet member such that the sheet member falls apart can be prevented.

9) During oblique stapling, a staple can be punched in an identical position to a position set during parallel stapling at a fixed distance from the end surface, and therefore a situation in which the staple covers a printed surface of the sheet member can be prevented. As a result, an improvement in user-friendliness can be achieved.

According to the fifth and sixth embodiments of the present invention, means for moving the stapling means in an orthogonal direction to the sheet member conveyance direction, a single power source for driving the moving means, and means for rotating the stapling means, which are moved by the driving force of the drive source, during the aforementioned movement process are provided. The moving means for move the stapling means to a stapling position while maintaining a parallel stapling condition, in which the stapling means are not rotated, or an oblique stapling condition, in which the stapling means are rotated. Therefore, a simple structure comprising a single drive source can be provided, and the stapling position selection range can be set widely. As a result, it is possible to respond sufficiently to the various needs of a user.

Various modifications will become possible for those skilled in the art after receiving the teachings of the present disclosure without departing from the scope thereof.

What is claimed is:

1. A sheet processing apparatus comprising:

a stapling unit for stapling an inserted sheet member, the stapling unit including a stapler and a lever configured to contact a protrusion, the stapling unit being configured so that lever rotates the stapler as the lever contacts the protrusion;

a moving mechanism configured to move the stapling unit in an orthogonal direction to a sheet member conveyance direction; and a single drive source for driving the moving mechanism, wherein the protrusion is in a preset position during a process of moving the stapling unit using the moving mechanism, wherein the protrusion includes a first protrusion for setting the stapling unit in the oblique stapling condition, and a second protrusion for returning the stapling unit to the parallel stapling condition from the oblique stapling condition.

2. The sheet processing apparatus as claimed in claim 1, further comprising:

a first support member that contacts an end portion of the sheet member on an upstream side of the sheet member conveyance direction during alignment of the sheet member; and a second support member for supporting another part of the sheet member, wherein a stapling direction of the sheet stapling unit is parallel to a contact surface of the first support member.

3. The sheet processing apparatus as claimed in claim 2, wherein the moving mechanism is configured to move the stapling unit to an end portion of the sheet member when the stapling unit is in an oblique stapling condition and a parallel stapling condition.

4. The sheet processing apparatus as claimed in claim 3, further comprising:

a device for maintaining the attitude of the stapling unit in at least one of the oblique stapling condition and the parallel stapling condition.

5. The sheet processing apparatus as claimed in claim 4, wherein the device for maintaining the attitude includes an engaging member which engages with a member that rotates integrally with the stapler, thereby limiting the position of the stapling unit.

6. The sheet processing apparatus as claimed in claim 5, wherein the engaging member includes a sliding-resistant member.

7. The sheet processing apparatus as claimed in claim 5, wherein the engaging member is set at an angle of 45° to the sheet member end portion during oblique stapling.

8. The sheet processing apparatus as claimed in claim 1, wherein the moving mechanism is configured to move the stapling unit so that the lever contacts the protrusion to rotate the stapler within a preset range.

9. The sheet processing apparatus as claimed in claim 8, wherein the stapler is rotated by bringing the lever of the stapling unit into contact with the protrusion during a process of moving the stapling unit.

10. The sheet processing apparatus as claimed in claim 8, wherein the movement and rotation of the stapler are performed in a substantially vertical plane.

11. The sheet processing apparatus as claimed in claim 8, wherein a harness connected to the stapling unit is attached to a member that moves and rotates together with the stapler.

12. The sheet processing apparatus as claimed in claim 8, wherein a harness connected to the stapling unit is attached to the stapling unit.

13. The sheet processing apparatus as claimed in claim 1, wherein the moving mechanism moves the stapling unit to a stapling position while maintaining the stapling unit in a non-rotated parallel stapling condition or a rotated oblique stapling condition.

14. The sheet processing apparatus as claimed in claim 13, further comprising a maintaining unit for maintaining the condition of the stapling unit when the stapling unit enters the parallel stapling condition or the oblique stapling condition in relation to the sheet member.

15. The sheet processing apparatus as claimed in claim 14, wherein the maintaining unit includes an engaging portion which is engaged between a pedestal of the stapling unit and a rotary member for rotating a support member that supports a stapling portion of the stapling unit.

16. The sheet processing apparatus as claimed in claim 15, wherein the engaging portion possesses elasticity.

17. The sheet processing apparatus as claimed in claim 13, wherein, in the oblique stapling condition, the stapling unit is tilted 45° relative to an end portion of the sheet member in the sheet member conveyance direction.

18. The sheet processing apparatus as claimed in claim 1, wherein the stapling unit performs parallel stapling in at least one location in a central portion of the sheet member in a width direction thereof.

19. The sheet processing apparatus as claimed in claim 1, wherein the stapling unit is set in a standby position in which the stapling unit does not perform a stapling operation on the sheet member, and in the standby position, the stapling unit can be replenished with staple members.

20. The sheet processing apparatus as claimed in claim 19, wherein the standby position is situated on a front side of a front side plate of an apparatus main body.

21. The sheet processing apparatus as claimed in claim 1, wherein a distance from an end portion of the sheet member in the sheet member conveyance direction to a staple member in a parallel stapling condition is equal to a distance from the end portion to the staple member in an oblique stapling condition.

22. An image forming apparatus comprising:

a sheet processing apparatus, wherein the sheet processing apparatus includes a first support member that contacts an end portion of a sheet member on an upstream side of a sheet member conveyance direction during alignment of the sheet member, a second support member for supporting another part of the sheet member, a stapling unit for stapling an inserted sheet member, the stapling unit including a stapler and a lever configured to contact a protrusion, the stapling unit being configured so that lever rotates the stapler as the lever contacts the protrusion, a moving mechanism configured to move the stapling unit in an orthogonal direction to a sheet member conveyance direction, and a single drive source for driving the moving mechanism, wherein the protrusion is in a preset position during a process of moving the stapling unit using the moving mechanism, wherein the protrusion includes a first protrusion for setting the stapling unit in the oblique stapling condition, and a second protrusion for returning the stapling unit to the parallel stapling condition from the oblique stapling condition.

* * * * *